US008011025B2

(12) United States Patent
Lee

(10) Patent No.: US 8,011,025 B2
(45) Date of Patent: Sep. 6, 2011

(54) MULTIFUNCTIONAL SAFETY HELMET

(75) Inventor: Te Lung Lee, Tainan (TW)

(73) Assignee: Long Huei Helmet Co., Tainan (TW)

( * ) Notice: Subject to any disclaimer, the term of this patent is extended or adjusted under 35 U.S.C. 154(b) by 877 days.

(21) Appl. No.: 12/068,777

(22) Filed: Feb. 12, 2008

(65) Prior Publication Data

US 2008/0216215 A1 Sep. 11, 2008

(30) Foreign Application Priority Data

Mar. 5, 2007 (TW) ..... 96107572 A

(51) Int. Cl.
*A42B 3/18* (2006.01)

(52) U.S. Cl. ..... 2/424; 2/6.5; 2/15; 2/425

(58) Field of Classification Search ..... 2/455, 410, 2/6.1, 6.5, 423, 424, 425, 15, 9
See application file for complete search history.

(56) References Cited

U.S. PATENT DOCUMENTS 6,226,803 B1 * 5/2001 Tanaka ..... 2/424
6,851,129 B2 * 2/2005 Gafforio et al. ..... 2/424
7,814,579 B2 * 10/2010 Dion ..... 2/425
7,841,026 B2 * 11/2010 Makris et al. ..... 2/424
2003/0088907 A1 * 5/2003 Gafforio et al. ..... 2/424
2006/0064799 A1 * 3/2006 Dion ..... 2/424
2007/0124851 A1 * 6/2007 Pyo ..... 2/424
2007/0250993 A1 * 11/2007 Schimpf ..... 2/424
2011/0094019 A1 * 4/2011 Isobe ..... 2/424

* cited by examiner

*Primary Examiner* — Christopher Harmon
(74) *Attorney, Agent, or Firm* — Bacon & Thomas, PLLC

(57) ABSTRACT

The present invention is to provide a multifunctional safety helmet which comprises: a shell, having a concavity at each side that forms a protection lump at its front; a chin shield, positioned in the front of the shell where each of the top sides has an ear cover, where the chin shield is pivoted on both sides of the shell with a fixing by a lift adjusting device; a clasp device, located in the interior of the front bottom of the chin shield and the interior of the protection lump of the shell, comprising: a button, linked by a spring for automatic bounce back; a link pole, with one end connecting to the end of the button; a slide, embedded in the seat, and connected to the other end of the link pole; a clasp chunk, positioned under the slide; and a movable clasp body, located inside the protection lump of the shell, and fastened by a cover, where an opening is devised for accommodating the slide, and an elastic element is placed between the clasp body and the cover, while the clasp body further comprises a flat piece, a clasp notch and a clasp hook, and the clasp notch is used for accommodating the clasp chunk and for seizing the clasp hook mutually; and a visor, pivoted within the lift adjusting device; accordingly, the join of the headpieces being firm and tight through the realization of the foregoing mentioned structure.

13 Claims, 26 Drawing Sheets

MULTIFUNCTIONAL SAFETY HELMET

BACKGROUND OF THE INVENTION

1. Field of the Invention

The present invention relates generally to multifunctional safety helmets, and more particularly, to one where the join of headpieces is firm and tight, while the assembly and the discharge are easy and prompt.

2. Description of the Prior Art

The prior art of the present invention was issued a patent: U.S. Pat. No. 6,212,689, which offered a multifunctional safety helmet that featured continuity in the manipulation and tightness in the join; however, the inventor recognized it was imperative to improve the tightness in the join of headpieces which gave birth to the present invention.

SUMMARY OF THE INVENTION

It is an object of the present invention to provide a multifunctional safety helmet that ensures the tightness in the join of the headpieces.

It is another object of the present invention to provide a multifunctional safety helmet that features simplicity and promptness in the assembly and the discharge. The present invention comprises: a shell, having a concavity each at both sides, and a protection lump at its front; a chin shield, positioned in the front of the shell and an ear cover at each of its top sides, where the chin shield is pivoted on both sides of the shell with a fixing by a lift adjusting device; a clasp device, located in the interior of the front bottom of the chin shield and the interior of the protection lump of the shell, comprising: a button, linked by a spring for automatic bounce back; a link pole, with an end connecting to the bottom of the button; a slide, embedded in the seat, and connected with the other end of the link pole; a clasp chunk, positioned under the slide; and a movable clasp body, located inside the protection lump of the shell, and fastened by a cover, while an opening is devised for accommodating the slide, where an elastic element is existed between the clasp body and the cover, and the clasp body comprises a flat piece, a clasp notch and a clasp hook, where the clasp notch is used for accommodating the clasp chunk and for seizing the clasp hook mutually; and a visor, pivoted in the lift adjusting device; accordingly, the join is capable of being tight through the realization of the foregoing mentioned structure.

BRIEF DESCRIPTION OF THE DRAWINGS

1.

7.

DETAILED DESCRIPTION OF THE INVENTION

Figure 1:
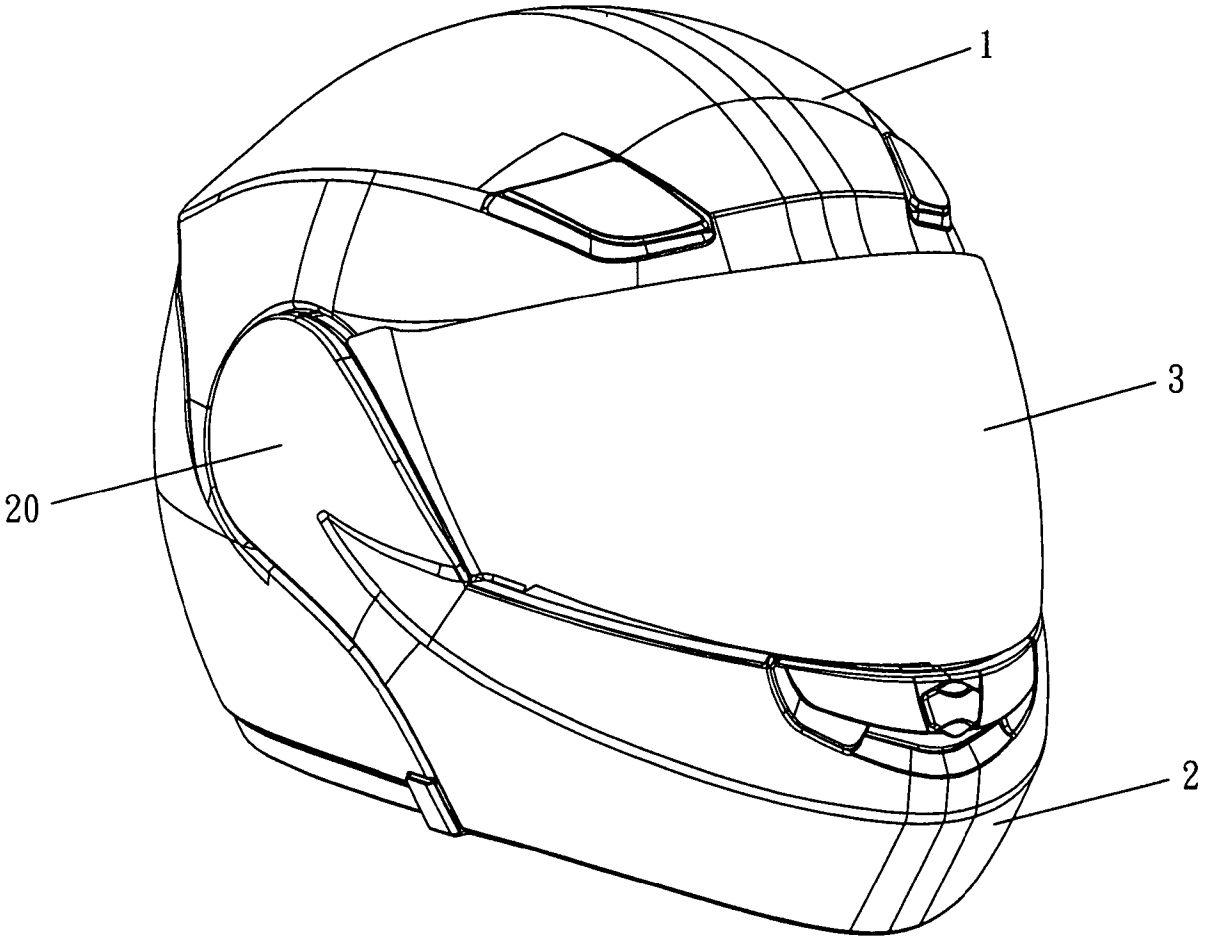
FIG. 1 is a three-dimensional exterior view for the embodiment of the present invention;
2.

The following preferred embodiment and the accompanying drawings are provided to describe in detail the structural traits and the function of the present invention that would be helpful in comprehending the present invention for the honorable Examiner.

For the start, referring to FIGS. 1-8, the present invention comprises:

a shell 1, having a concavity 11 at each of its both sides, where the concavity 11 includes a plurality of openings 12, and the shell 1 has a protection lump 13 at each side of its front bottom.

a chin shield 2, referring to FIGS. 2-6, positioned in the front of the shell 1, being a arced frame where an ear cover 20 is on each of its top sides, and pivoted with a lift adjusting device 5 (describe it later on) to fix the chin shield 2.

Figure 2:
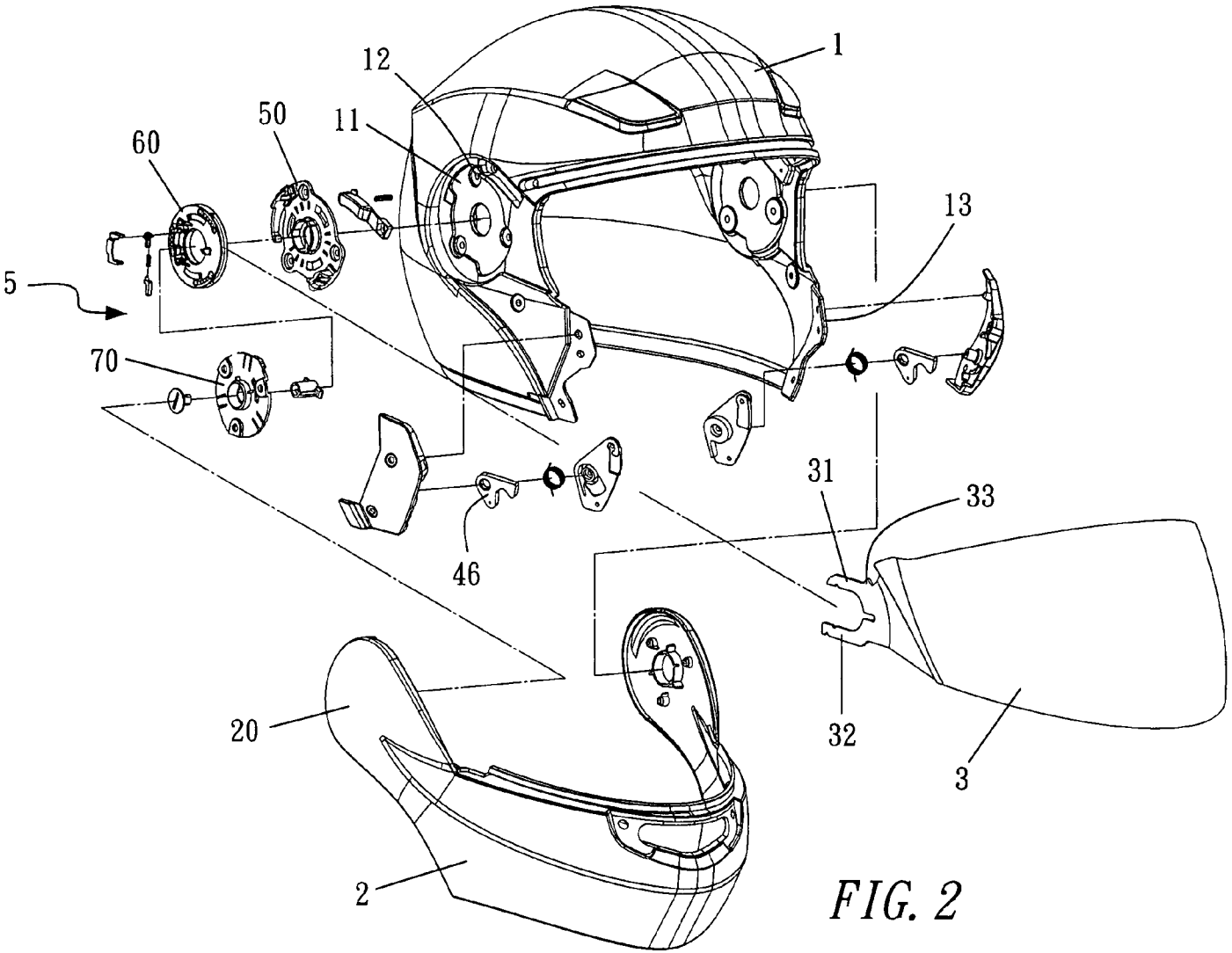
FIG. 2 is a three-dimensional exploded view of the embodiment of the present invention;
3.
Figure 3:
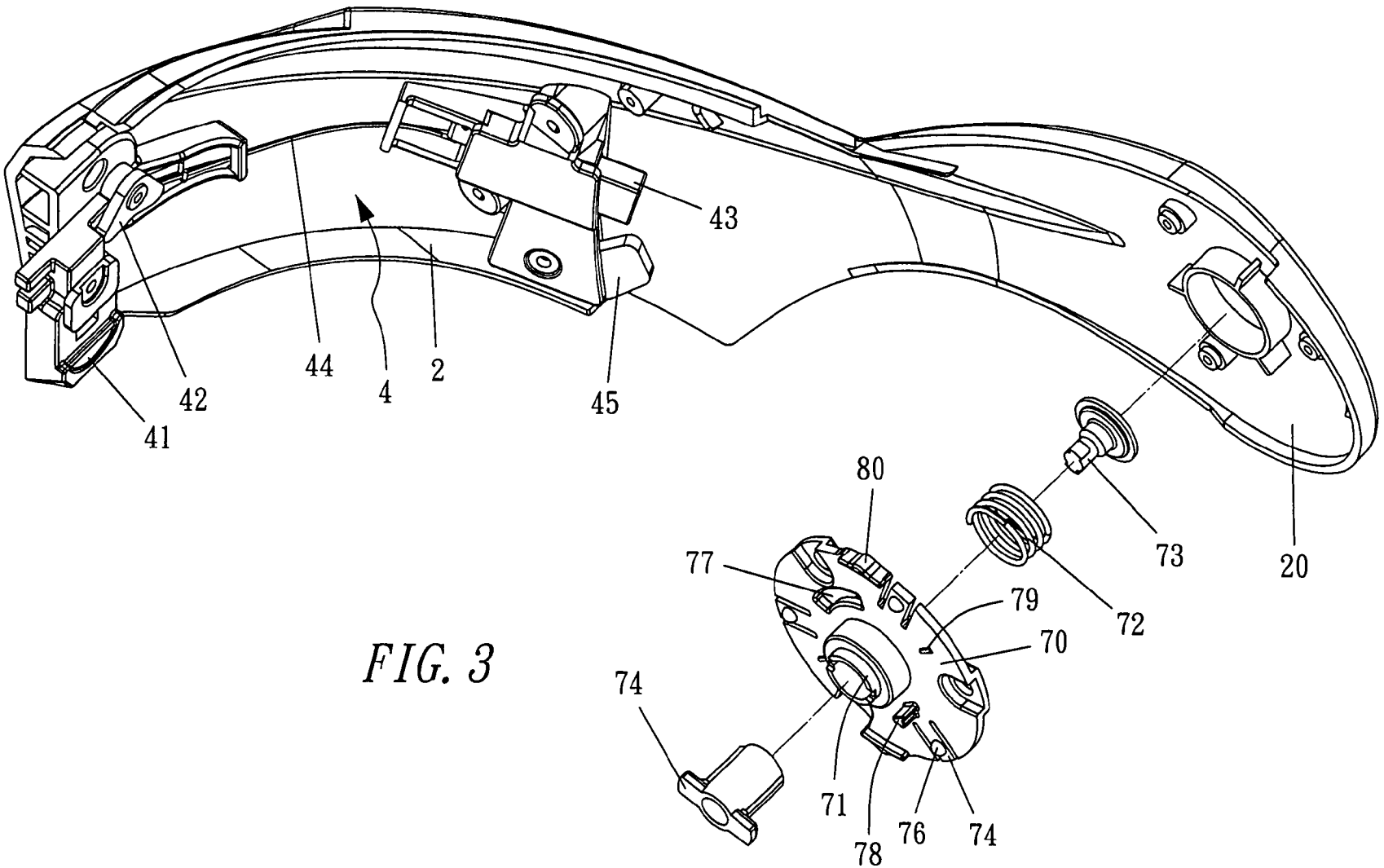
FIG. 3 depicts the exploded view (I.) of the parts of the chin shield and the clasp device of the embodiment of the present invention;
4.
Figure 4:
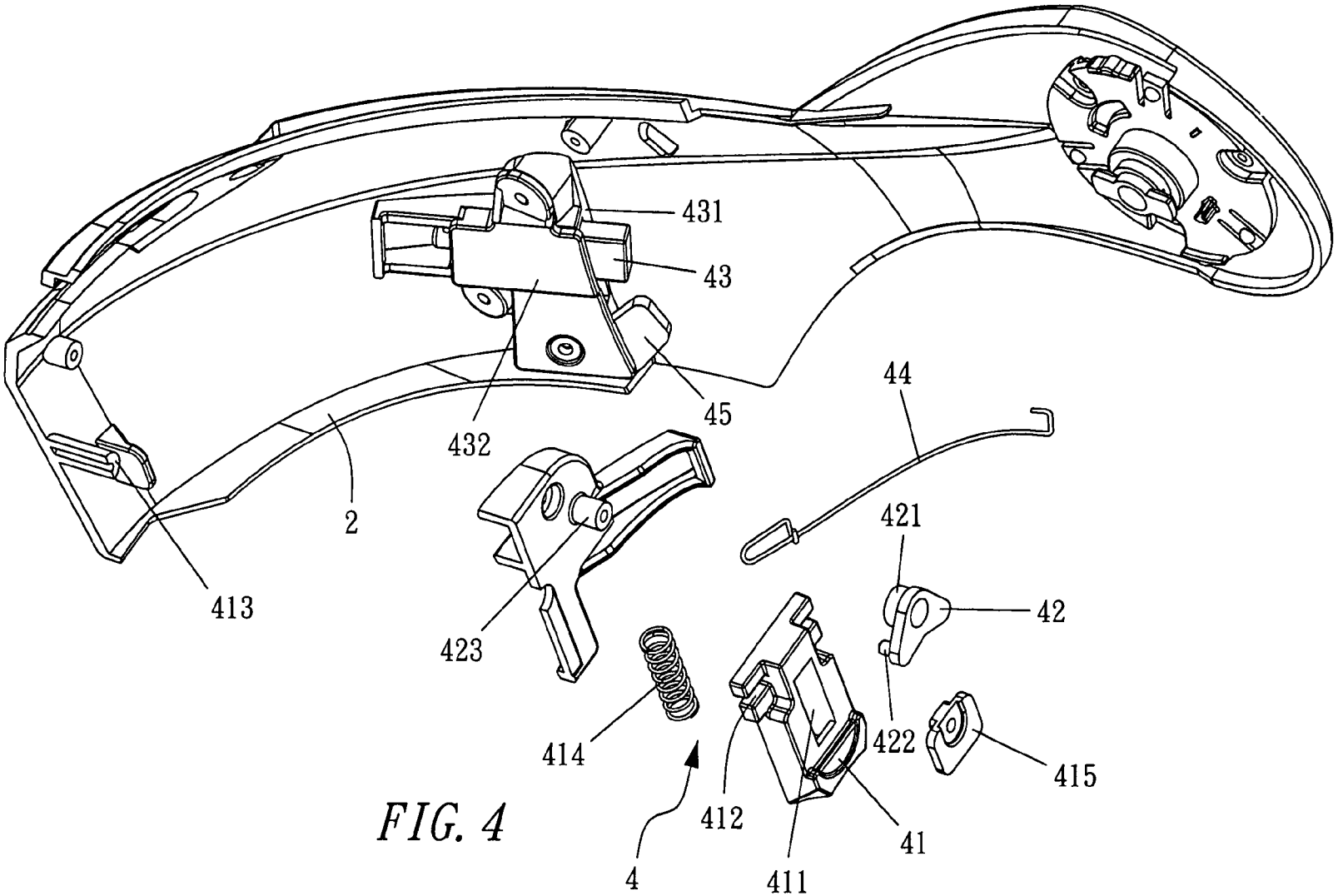
FIG. 4 depicts the exploded view (II.) of the parts of the chin shield and the clasp device of the embodiment of the present invention;
5.
Figure 5:
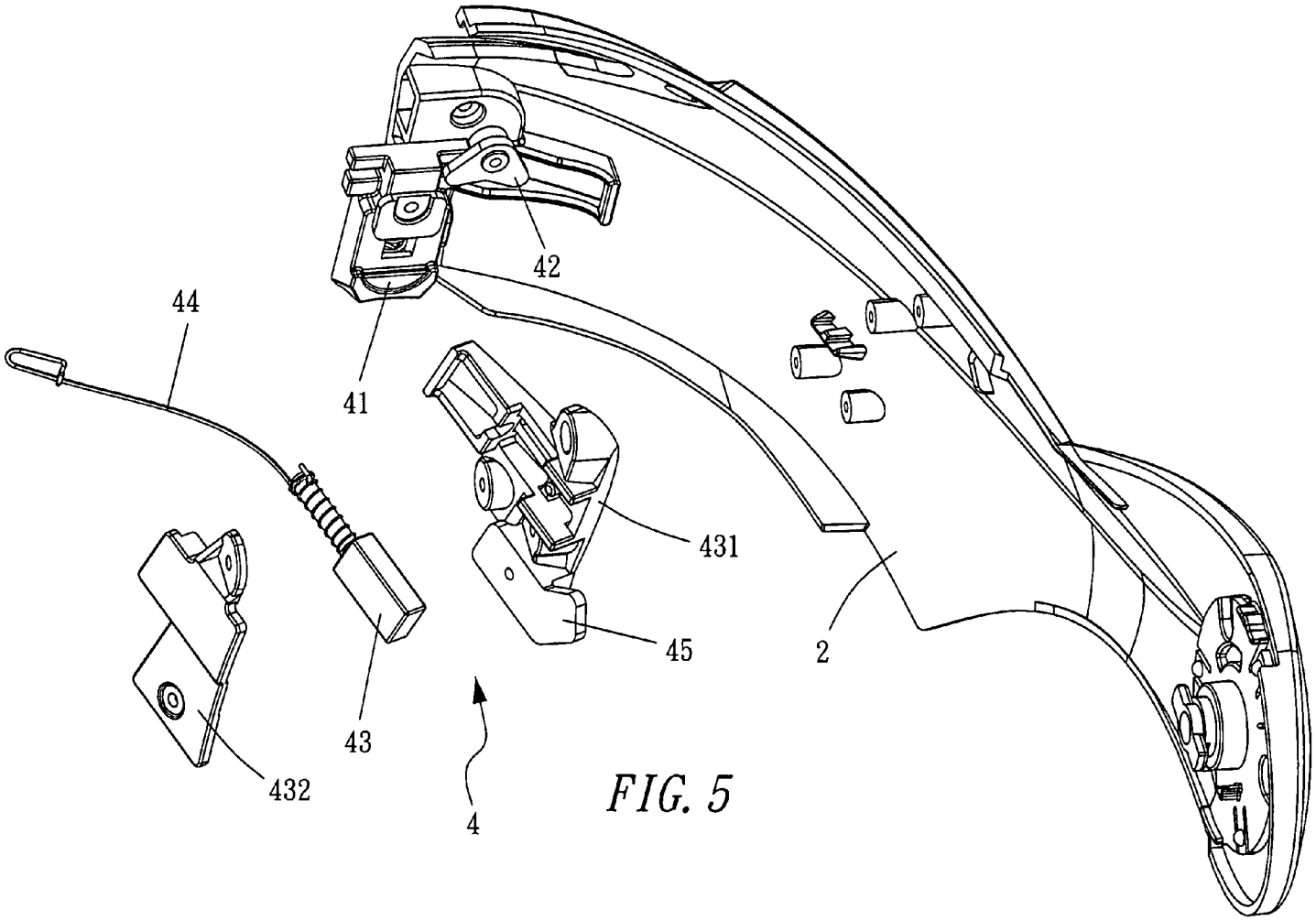
FIG. 5 depicts the exploded view (III.) of the parts of the chin shield and the clasp device of the embodiment of the present invention;
6.
Figure 6:
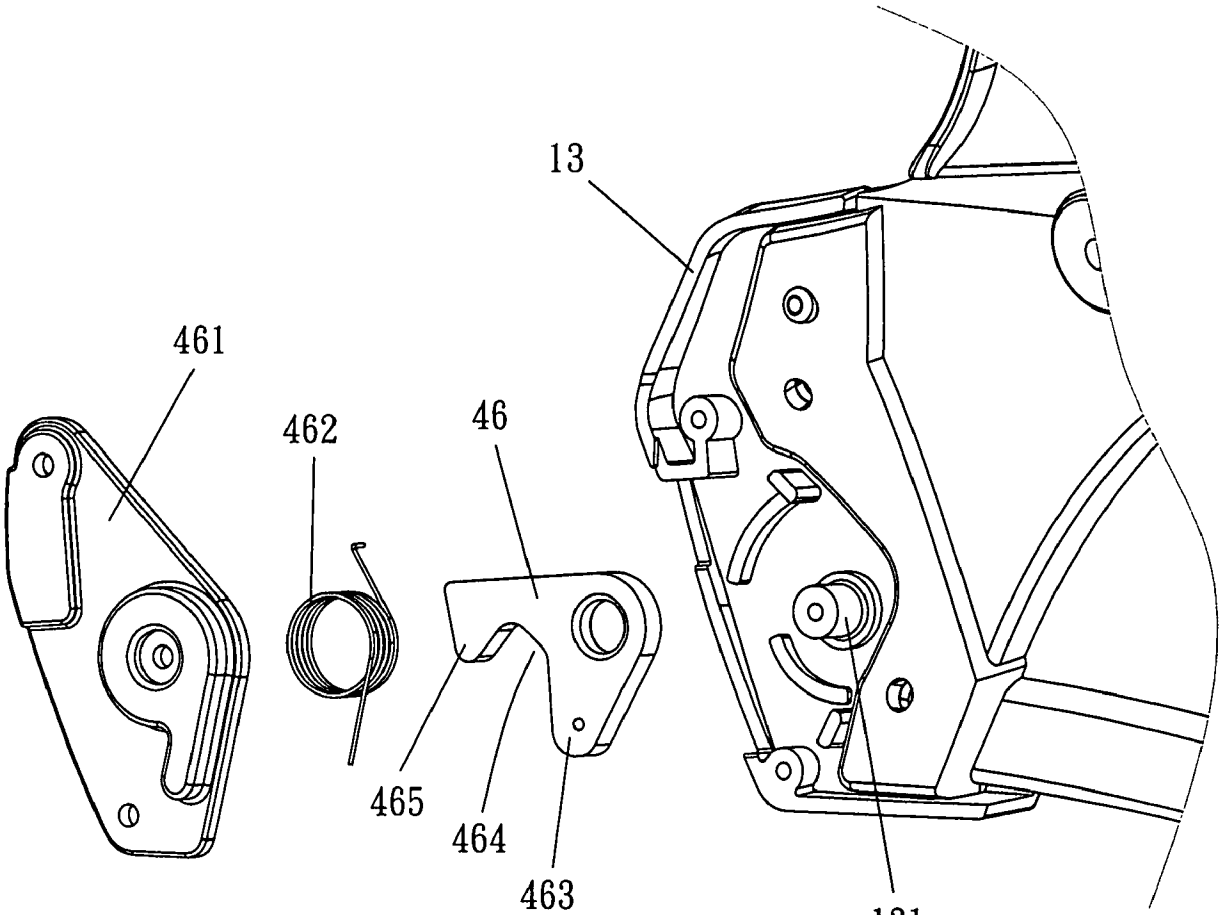
FIG. 6 depicts the exploded view (IV.) of the parts of the chin shield and the clasp device of the embodiment of the present invention.
Figure 7:
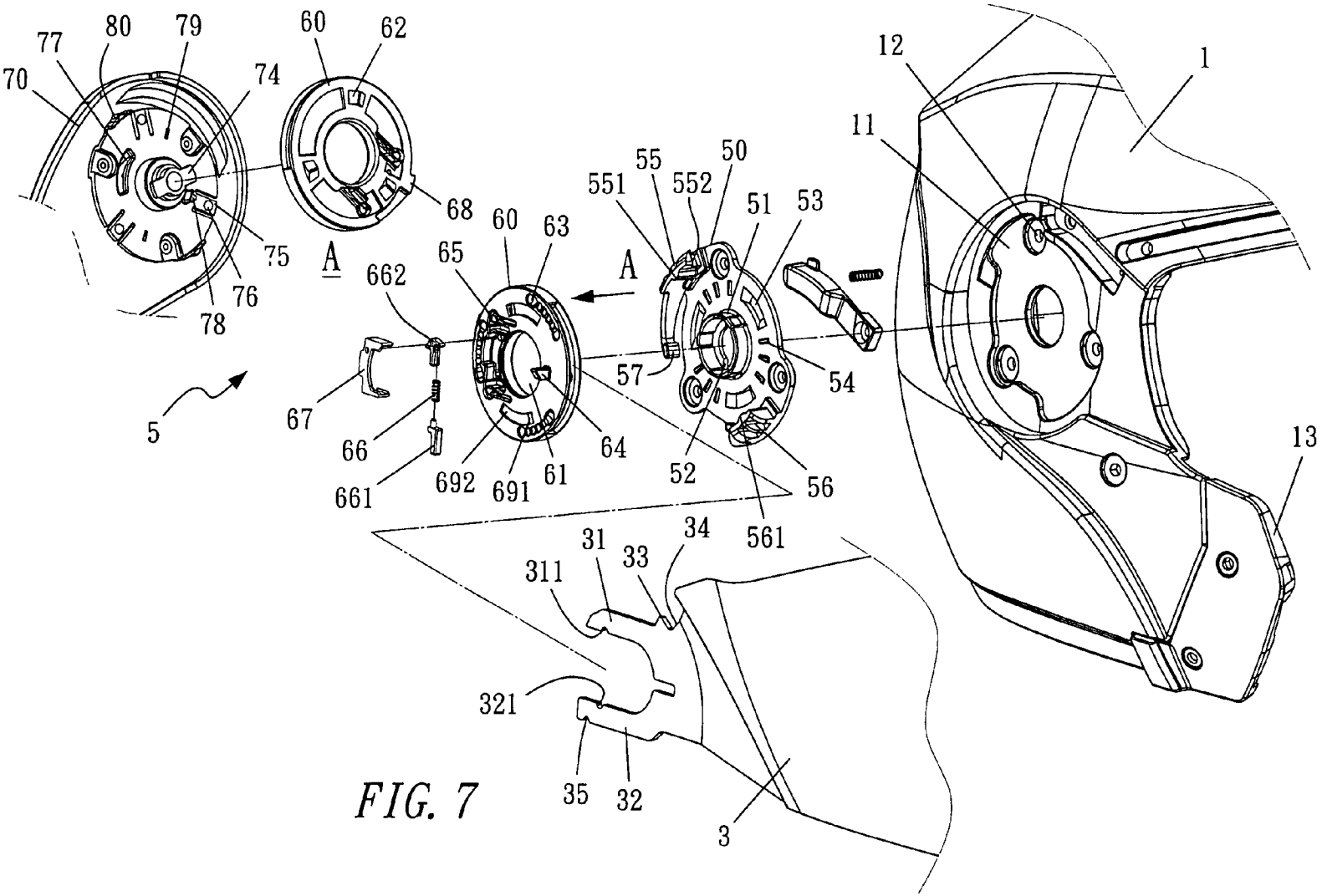
FIG. 7 is an enlarged exploded view of the parts of the shell and the lift adjusting device of the embodiment of the present invention;
8.

The chin shield 2 is provided with a clasp device 4 at the interior of its bottom, which comprises: a button 41, a long trough 411 in the middle, a tube 412 at each of its both front ends, where the long trough 411 is used to put around a pole 413, where a spring 414 is placed inside of it, and the button 41 and the spring 414 are fastened by a fixing slice 415, a screw and the pole 413, which rebounds the pressed button 41 to the original place by the restoring force of the spring 414; two slide pieces 42, shaped near a triangle, having a cap 421 at the bottom, and a post 422 at each of the two sides of the front, where the cap 421 is put around a pole 423 followed by a fastening to fix the slide pieces 42, and it rotates around the pole 423, where one end of the post 422 is placed in the tube 412 of the button 41; a slide 43, devised to locate in a seat 431, where the seat 431 is fastened by an outer cover 432 on its top to immobile the slide 43; a link pole 44, having its one end connected with the other post 422 of the slide piece 42, and having its the other end connected with the slide 43; a clasp chunk 45, fixed in one end of the seat 431 and located down the slide 43; a movable clasp body 46, located in a rod 131 of the interior of the protection lump 13 of the shell 1, and fastened by a cover 461 and a screw, which makes the interior of the protection lump 13 to form an opening 47 to accommodate the clasp body 46, where an elastic element 462 is placed in between the clasp body 46 and the cover 461, for instance, a snail-shaped spring, and the clasp body 46 has a shape near a triangle, comprising a flat piece 463, a clasp notch 464 and a clasp hook 465.

a lift adjusting device 5, referring to FIGS. 2, 3, 7-9, comprising: a mount 50, fixed in the dent 11 of the shell 1 by a rivet or a screw, and an elastic catch ring 51 being in the middle, where the catch ring 51 is provided with a keyhole-shaped clasp hole 52 at its bottom, and a plurality of arced chutes 53 are equally distanced along the catch ring 51 while a plurality of radial protruding bars 54 are placed between any of two consecutive arced chutes 53. There are a first barrier 55 and a second barrier 56 opposite to each other and are located on the external rim of the mount 50. The first barrier 55 and the second barrier 56 have arced chunks 551, 561 respectively at the inner side, where the first barrier 55 is provided with a groove 552 at one side, while the other side is extended to form an elastic hook 57; a segment disc 60, shaped a hollow, where the central hole 61 is used to put around the elastic catch ring 51 of the mount 50, and its inner side has a plurality of equally distanced and triangular shaped bulges 62 which are fitted into the arced chutes 53 of the mount 50, whereas the outer side has several sets of a plurality of caves 63, two shallow notches 691 opposite to each other and an arced shallow trough 692, and a barrier 64 with a slope on its top. The segment disc 60 is provided with two clasp slices 65 on its surface, where between the two consecutive clasp slices 65 there are a fixed hold piece 661 and a rotatable prop piece 662. A spring 66 is devised to locate between the hold piece 661 and the prop piece 662, which enables the prop piece 662 maintain a contact position with the hold piece 661, where the hold piece 661 joins one of the clasp slices 65, and a spring cover 67 is used to shield the hold piece 661, the prop piece 662 and the spring 66 to form a hidden style of design. Additionally, the segment disc 60 has, on one side of its rim, a wedge piece 68 with a slope on its front; and a turntable 70, fixed at the interior of the ear cover 20 of the chin shield 2, having a shaft cap 71 in the middle, which covers a spring 72 and a shaft 73, where the shaft 73 has a tenon 74 at its end, which fits in the clasp hole 52 of the mount 50, followed by a twist on the tenon 74 and join it to the bottom of the mount 50 to fix the turntable 70 together with the mount 50, and to locate the segment disc 60 in between, where the turntable 70 accompanies the ear cover 20 for rotating with respect to the shaft 73; the turntable 70 has a plurality of equally distanced elastic slices 75, which has a bulge 76 at its end to form a design of elastic bulge 76, which can be placed in the cave 63 of the segment disc 60. Furthermore, the turntable 70 is provided with an arced trough 77 for the accommodation of the barrier 64 of the segment disc 60; a top pole 78, built on the back of the elastic slice 75, and two protruded bars 79 opposite to each other which can be placed in the shallow notch 691 of the segment disc 60, where the turntable 70 has, along its rim, two arced bulges 80 opposite to each other.

a visor 3, referring to FIGS. 2 & 7, having U-shaped connectors at both sides which can be inserted into the hollow segment disc 60, has two corresponding up and down sockets 31, 32, where the sockets 31, 32 form at the internal side an oval-shaped curve, which is used as a limiter for the visor 3 inserting in the segment disc 60. The inner sides, opposite to each other, of the sockets 31, 32 have indents 311, 321 respectively, which will join with the end bulge of the clasp slice 65 of the segment disc 60. The up socket 31 has a jag 33 at its end, where the jag 33 has an arced indent 34 at its back; whereas the down socket 32 has its front portion protruded over the segment disc 60 with a slope on the top of the portion, and a notch 35 at its bottom.

Figure 10:
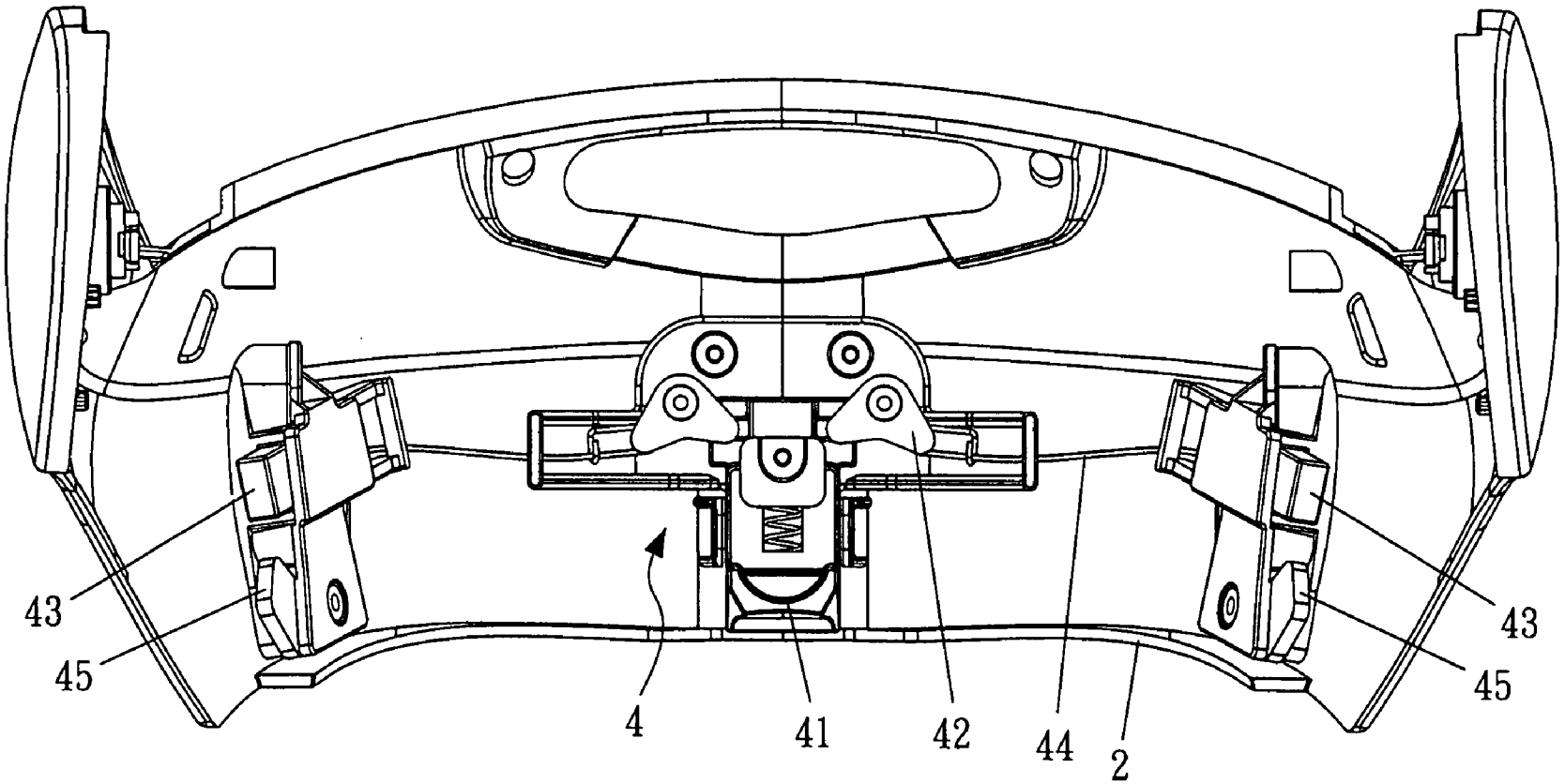
FIG. 10 is a front elevation showing the clasp device during the closing for the chin shield of the embodiment of the present invention;
11.

The assembly is accomplished based on the foregoing structure. If the chin shield 2 is at a closing state, the present invention will exhibit a full-masked view of a safety helmet, as in FIGS. 1, 10-11, where the slide 43 of the clasp device 4 is accommodated in the top opening 47 of the clasp body 46, and the clasp chunk 45 and the clasp hook 465 are latching each other to form a two-oriented join; the mount 50 of the lift adjusting device 5 is fixed at the exterior of the shell 1, and the turntable 70 is fixed at the interior of the ear cover 20, where each forms a single piece integrated by two parts, and a rotatable segment disc 60 is located in between the mount 50 and the turntable 70; besides, the visor 3 joins the segment disc 60, and the two are integral parts of one piece.

Figure 11:
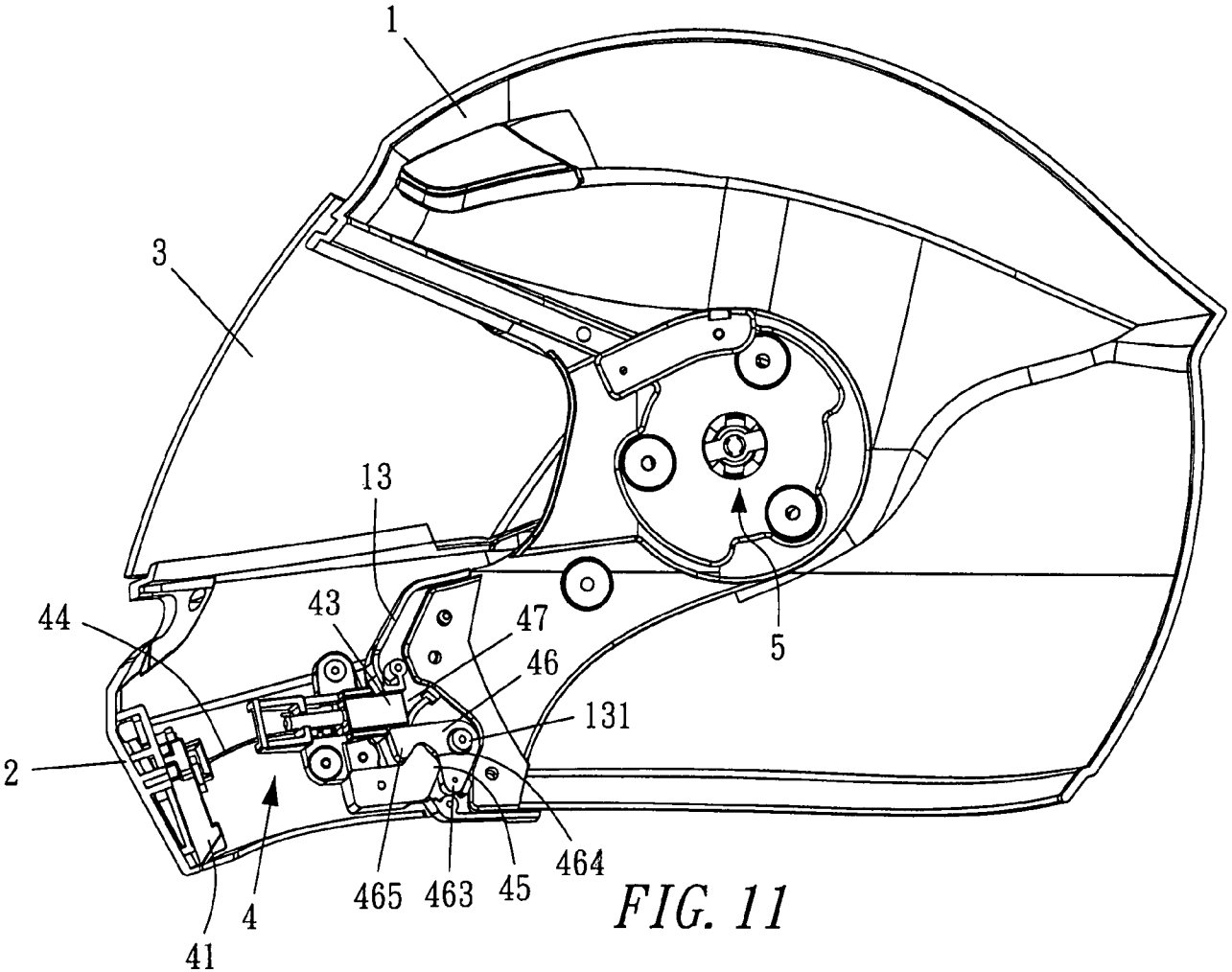
FIG. 11 is a side view showing the clasp device during the closing for the chin shield of the embodiment of the present invention;
12.
Figure 12:
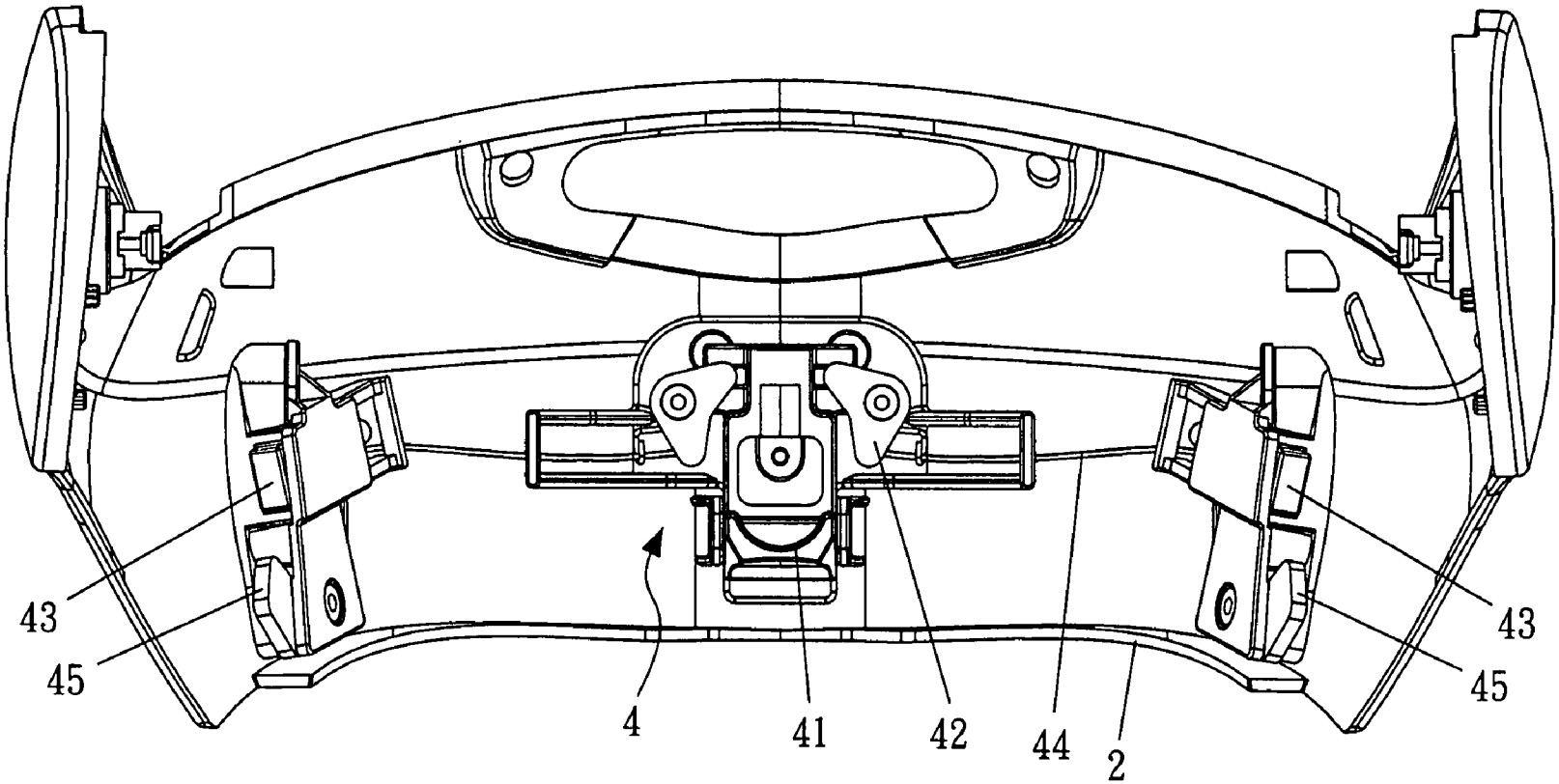
FIG. 12 is a front elevation showing the clasp device during the lifting for the chin shield of the embodiment of the present invention;
13.
Figure 13:
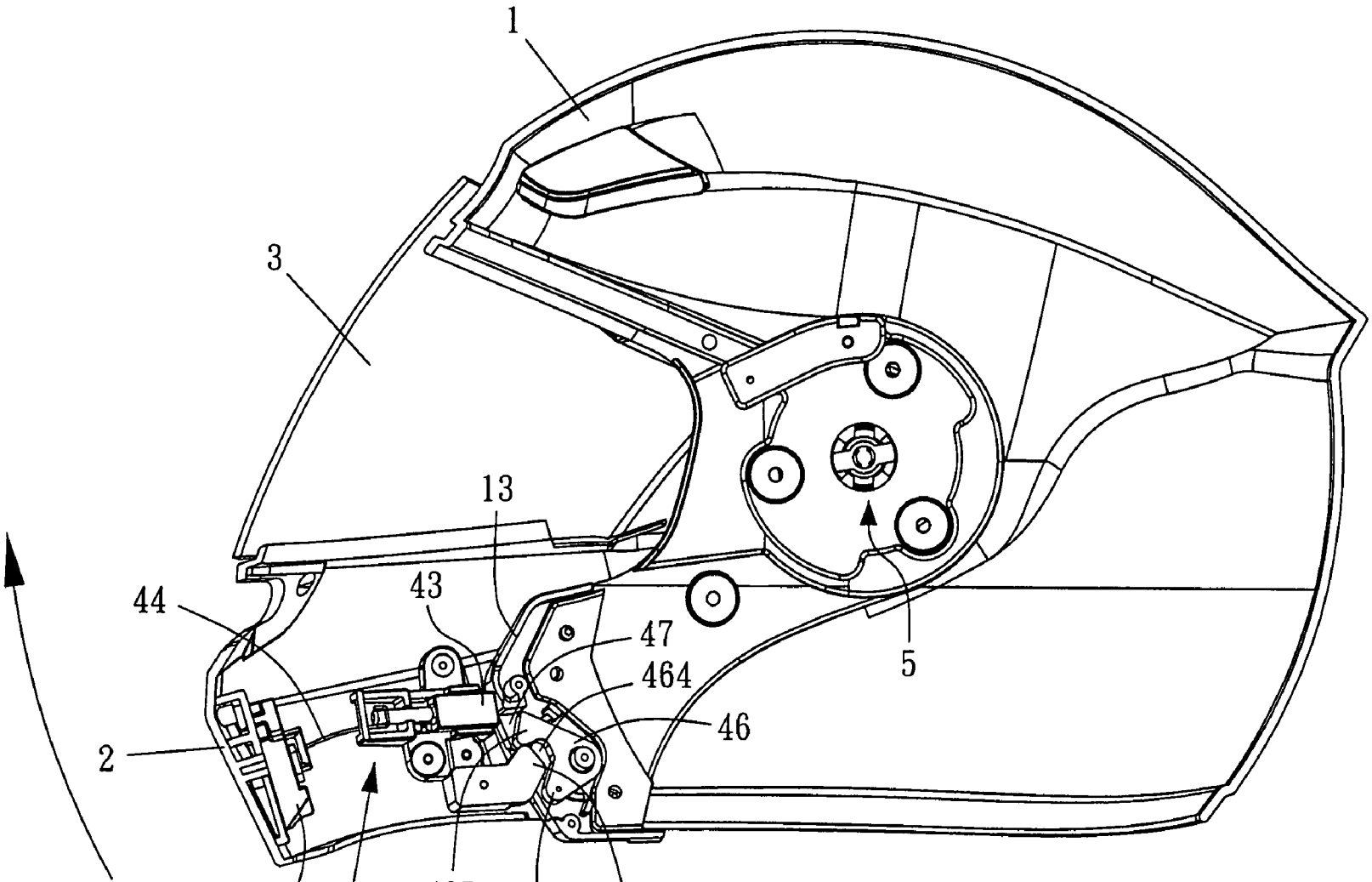
FIG. 13 is a side view showing the clasp device during the lifting for the chin shield of the embodiment of the present invention;
14.
Figure 14:
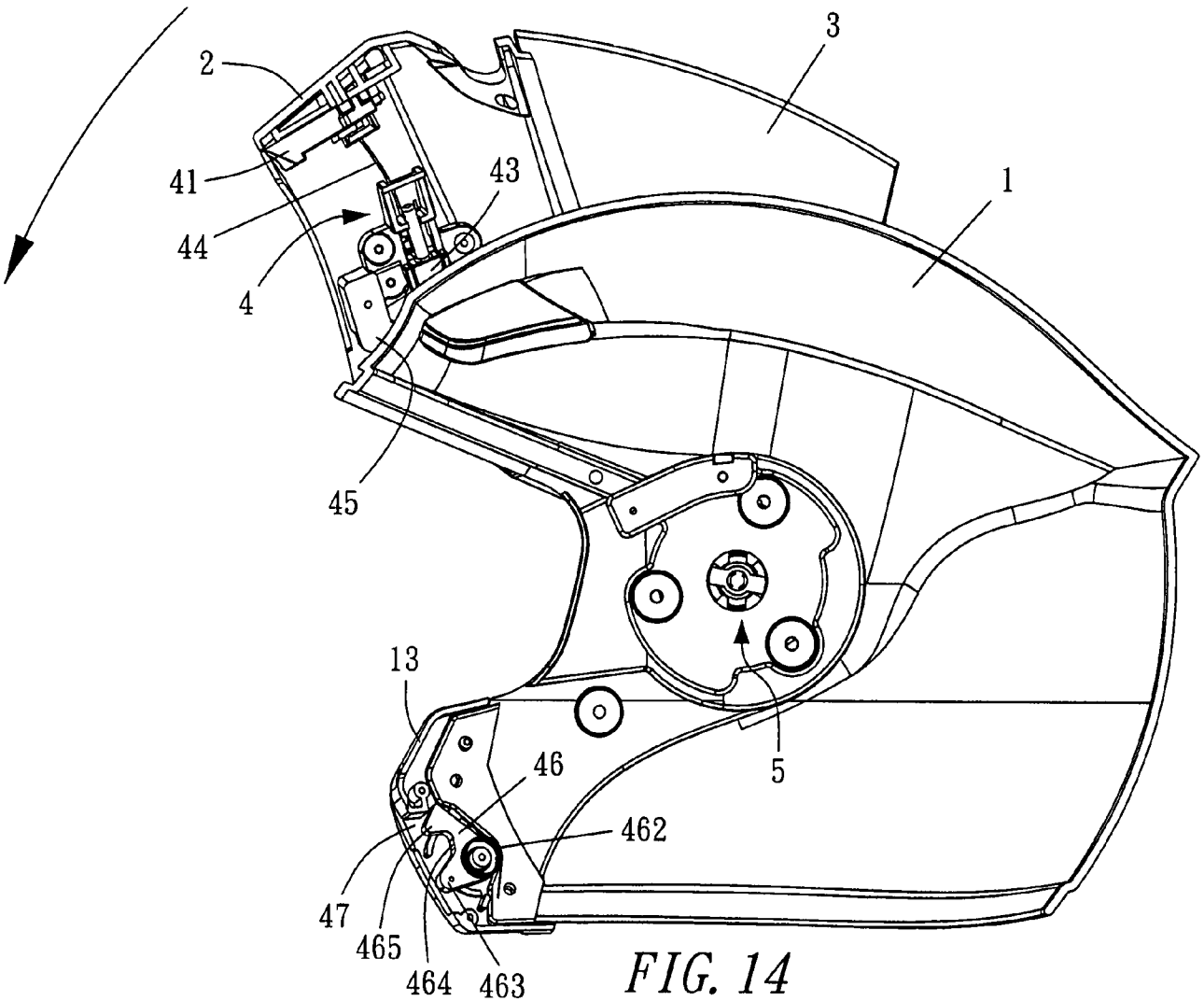
FIG. 14 is a side view showing the lifting of the chin shield to the full extent of the embodiment of the present invention;
15.
Figure 15:
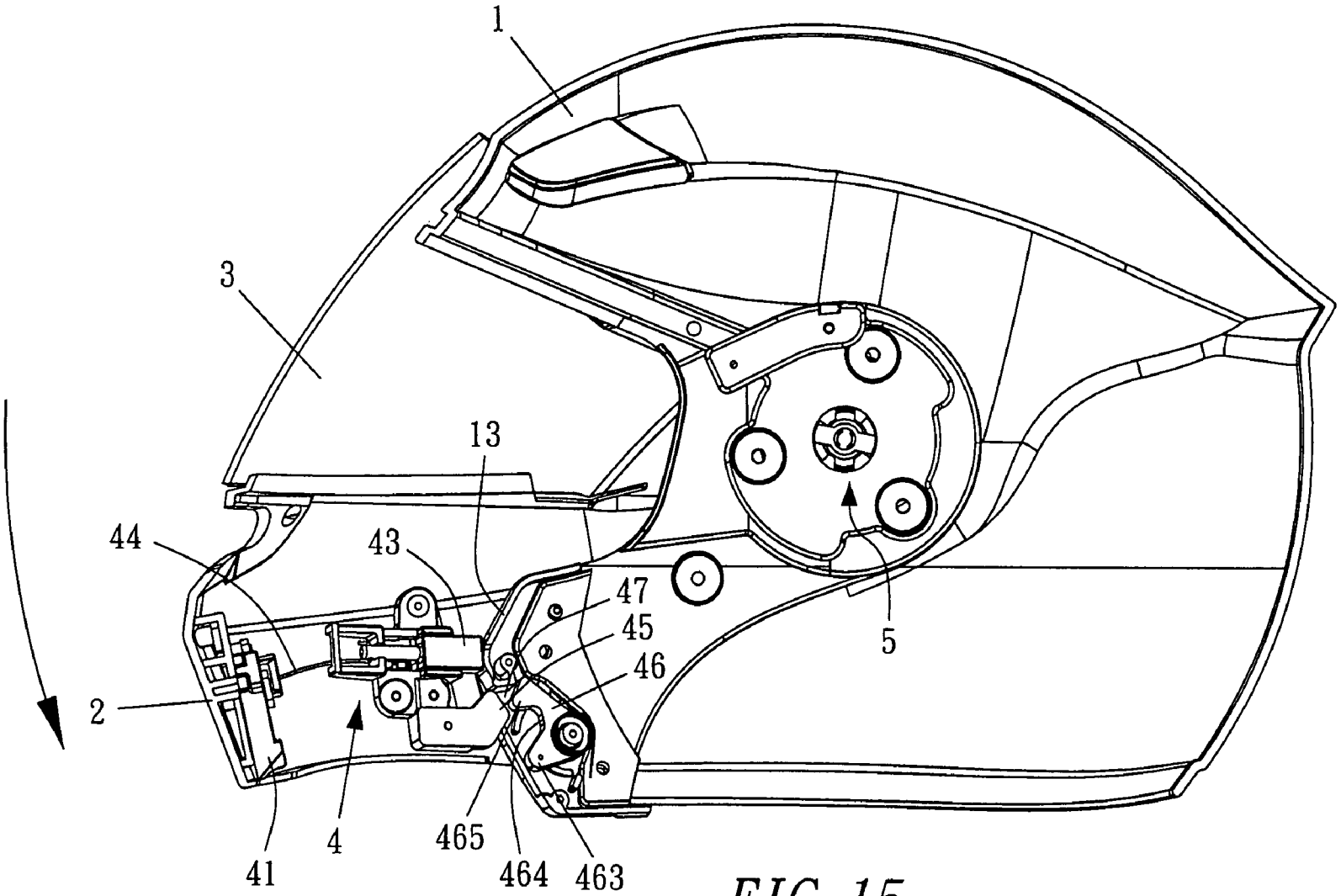
FIG. 15 is a side view showing the chin shield before the closing of the embodiment of the present invention;
16.

The lift of the chin shield 2 (can be a joint lift with the visor 3), as in FIGS. 12-14, is done by the hand holding the exterior of the chin shield 2, followed by the thumb pushing the button 41 up, to rotate the slide piece 42 in order to activate the link pole 44 that in turn pulls the slide 43 to move inward, and push the chin shield 2 upward synchronously, to depart the clasp chunk 45 from the clasp hook 465, and to break the slide 43 away the opening 47, for the accomplishment of the lift purpose, which shows the present invention in a half-masked view of a safety helmet; reversely, the closing of the chin shield 2, as in FIG. 15, is done by the hand pressing down the chin shield 2, to move the clasp chunk 45 of the clasp device 4 down through the protection lump 13 of the shell 1, across the clasp hook 465 of the clasp body 46 and the clasp notch 464, and to press down the flat piece 463 that makes the clasp body 46 rotate a certain degree, which moves the slide 43 along the protection lump 13 into the opening 47, where the clasp chunk 45 is being placed in the clasp notch 464 and engages a mutual hook with the clasp hook 465, which enables the closing state of the chin shield 2 shown in FIG. 11.

As the chin shield 2 is being lifted, aside from the foregoing described operation and control for the clasp device 4, it is also through the function of the lift adjusting device 5 which is located in between the ear cover 20 and the shell 1, where the moment the chin shield 2 is being lifted, the turntable 70 is simultaneously being activated to rotate with respect to the shaft 73, and further makes the segment disc 60 rotate. Since the visor 3 joins the segment disc 60, the visor 3 is then being lifted synchronously.

Figure 17:
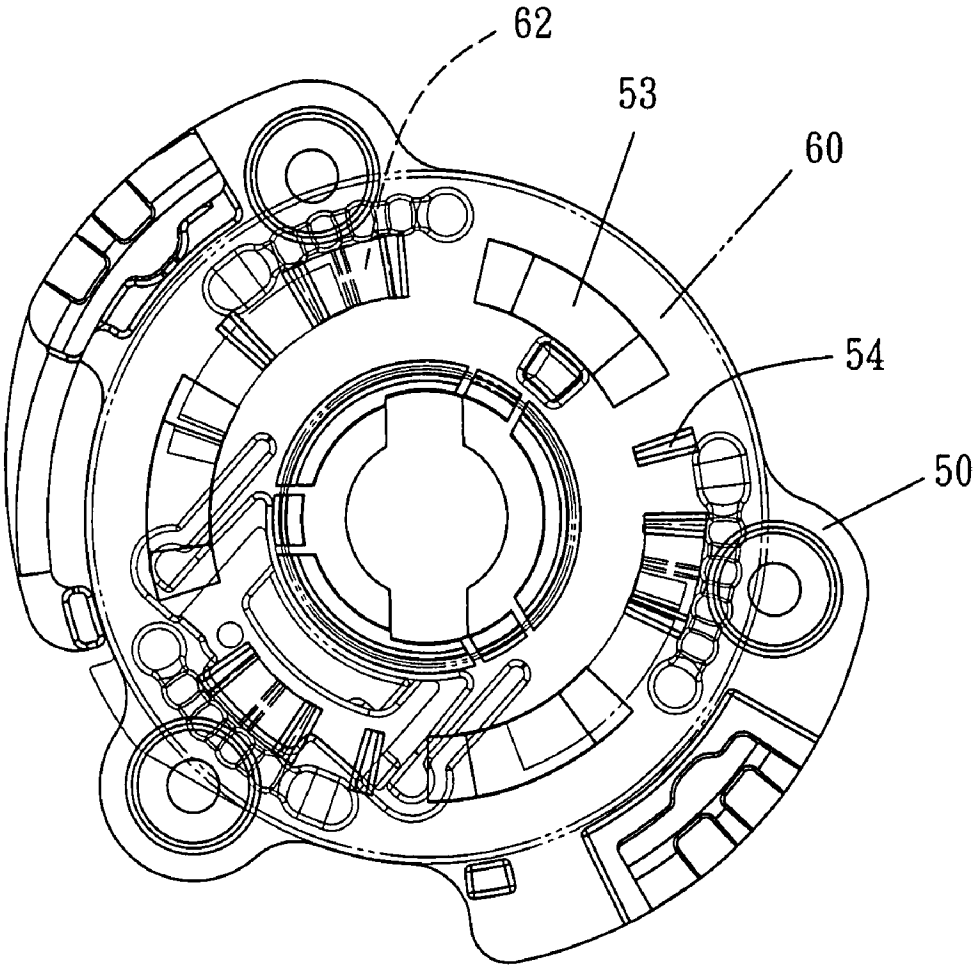
FIG. 17 is a partial schematic diagram (I.) showing the lift adjusting device during the half-lifting for the chin shield of the embodiment of the present invention;
18.
Figure 18:
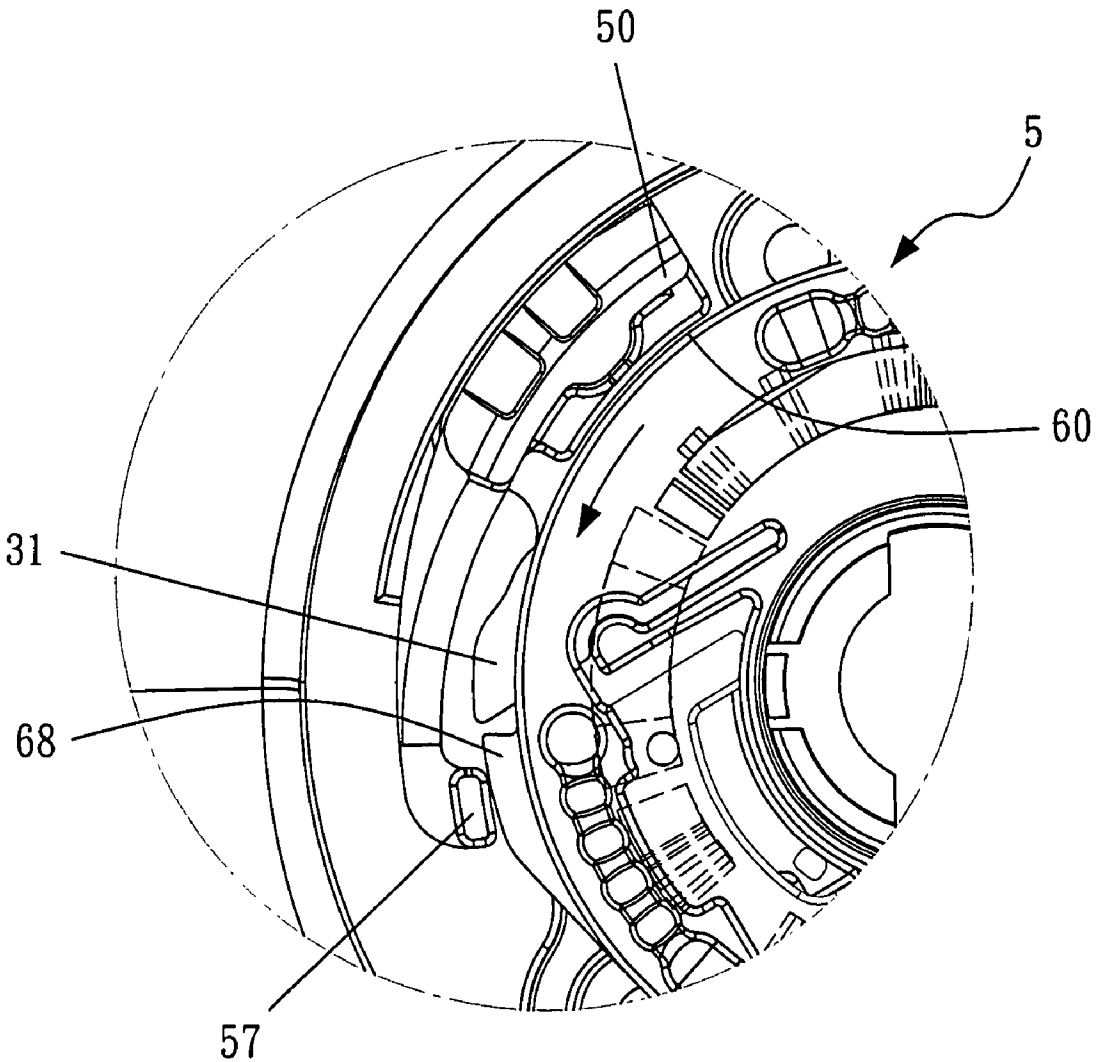
FIG. 18 is a partial schematic diagram (II.) showing the lift adjusting device during the half-lifting for the chin shield of the embodiment of the present invention;
19.

A further description about the lift adjusting device 5 of the present invention comprises the following three modes:

(I.) As the chin shield 2 and the visor 3 are simultaneously being lifted, the turntable 70 rotates subject to the lift of the ear cover 20, which synchronously rotates the segment disc 60 too, referring to FIGS. 16-20, where the interior bulge 62 of the segment disc 60 is activated to slide off the arced chute 53 of the mount 50, and moves across the protruding bar 54. At the moment, the segment disc 60 and the mount 50 are split slightly to form a gap. The wedge piece 68 of the segment disc 60 and the end portion of the up socket 31 of the visor 3 follow the rotation of the segment disc 60 to unfold the elastic hook 57 through the front slope of the wedge piece. 68, shown in FIGS. 17-18, and now the chin shield 2 and the visor 3 are exhibiting a half-lifting state; as the chin shield 2 are kept on pushing upward, the segment disc 60 and the turntable 70 keep on rotating, and the wedge piece 68 of the segment disc 60 and the end portion of the up socket 31 of the visor 3 will slide completely off the elastic hook 57. The arced indent 34 of the up socket 31 of the visor 3 is then joined in the groove 552 of the first barrier 55 of the mount 50, and the notch 35 of the down socket 33 of the visor 3 is joined outside the second barrier 56 of the mount 50, where the arced bulge 80 of the turntable 70 and the interior arced chunks 551, 561 of the two barriers 55, 56 of the mount 50 are joining each other, shown in FIGS. 19-20, the chin shield 2 and the visor 3 are now exhibiting a complete lifting state as in FIG. 14; once a closing is ready, it needs only a press on the chin shield 2 and the visor 3, which accompanies a reverse turn of the segment disc 60 and the turntable 70, and through the joining of the clasp device 4 to restore the chin shield 2 and the visor 3 to the closing state as in FIG. 11, where the lift adjusting device 5 restores the state in FIGS. 8 & 16.

Figure 16:
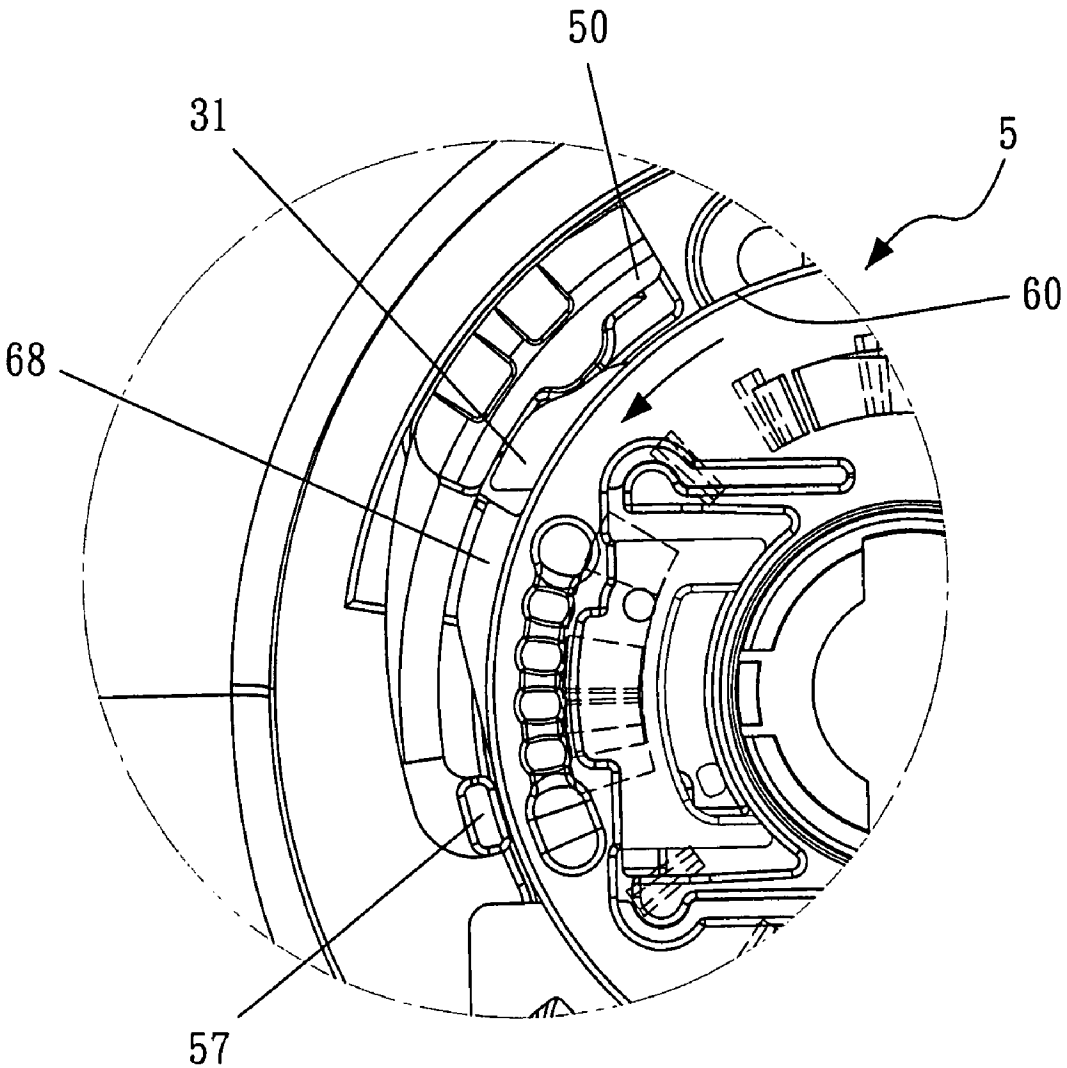
FIG. 16 is a partial schematic diagram showing the lift adjusting device during the closing for the chin shield of the embodiment of the present invention;
17.
Figure 19:
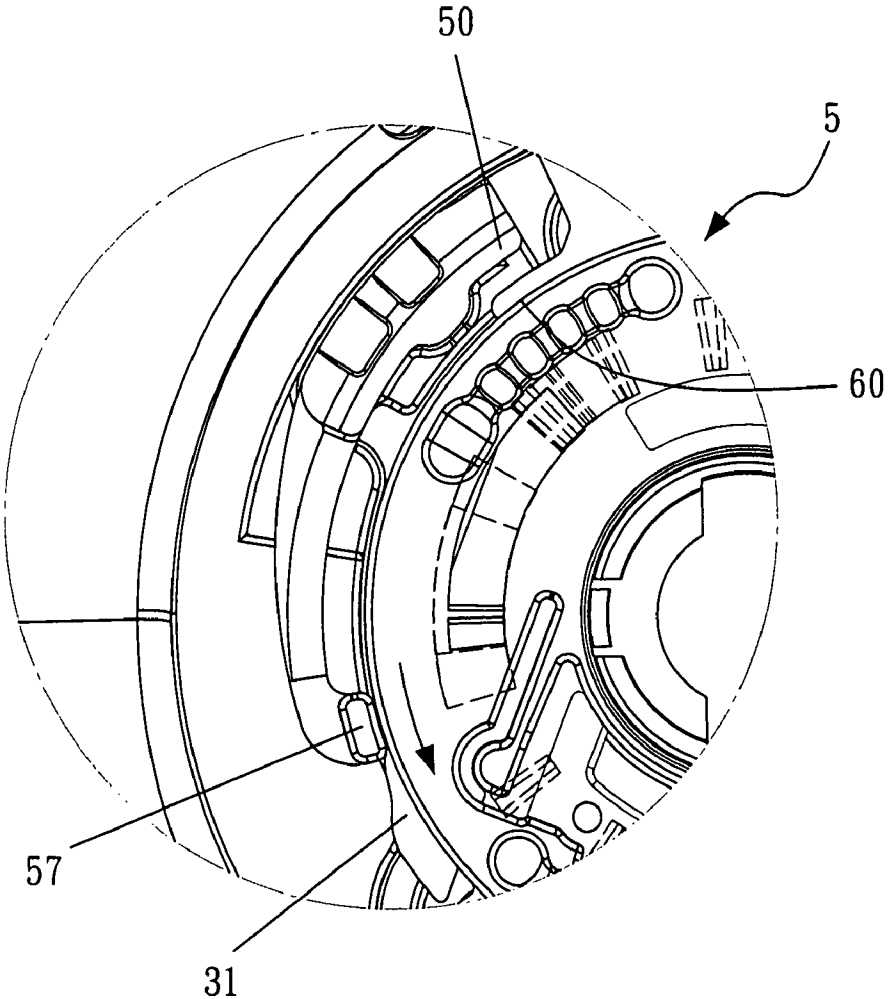
FIG. 19 is a partial schematic diagram (I.) showing the lift adjusting device during the lifting for the chin shield of the embodiment of the present invention;
20.
Figure 20:
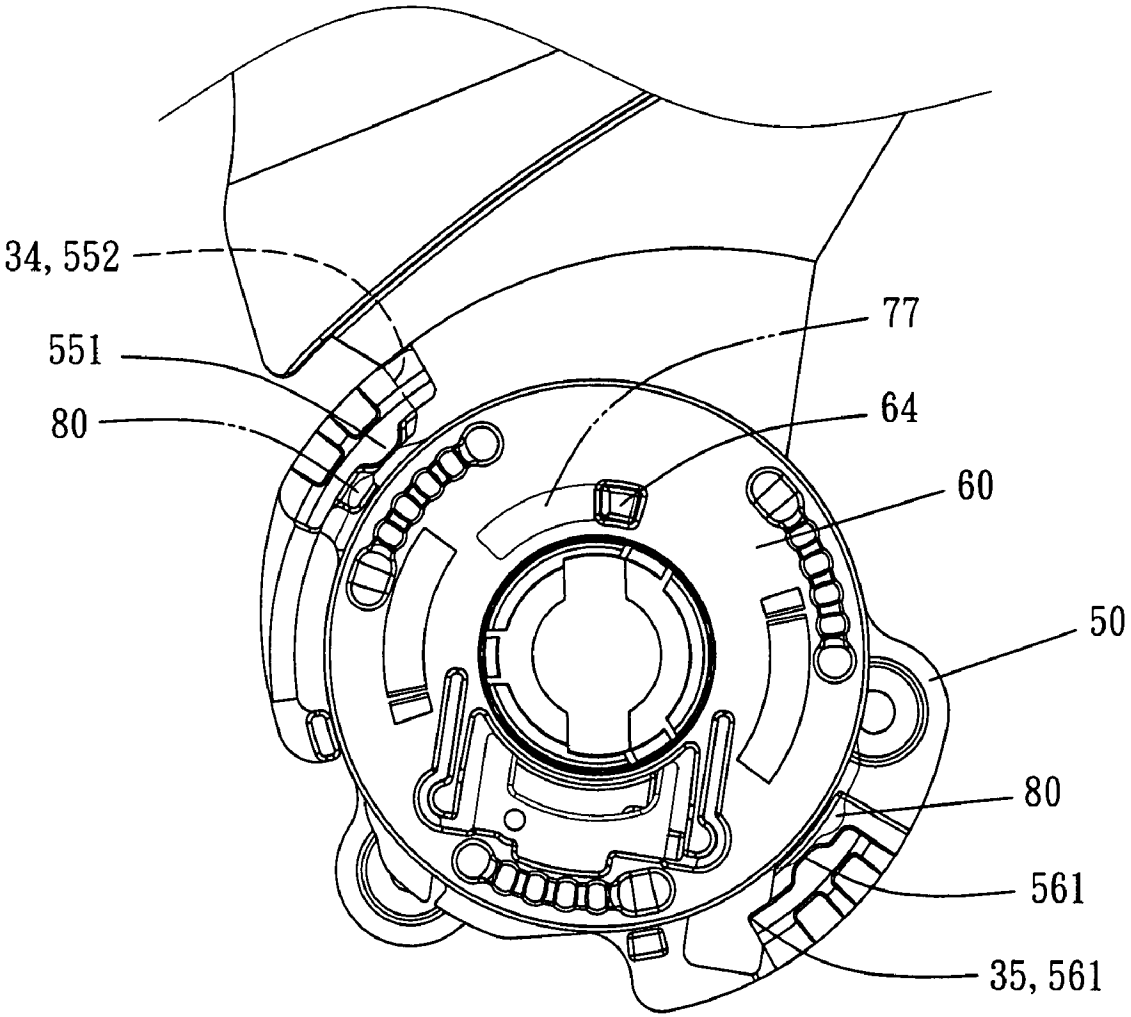
FIG. 20 is a partial schematic diagram (II.) showing the lift adjusting device during the lifting for the chin shield of the embodiment of the present invention;
21.
Figure 21:
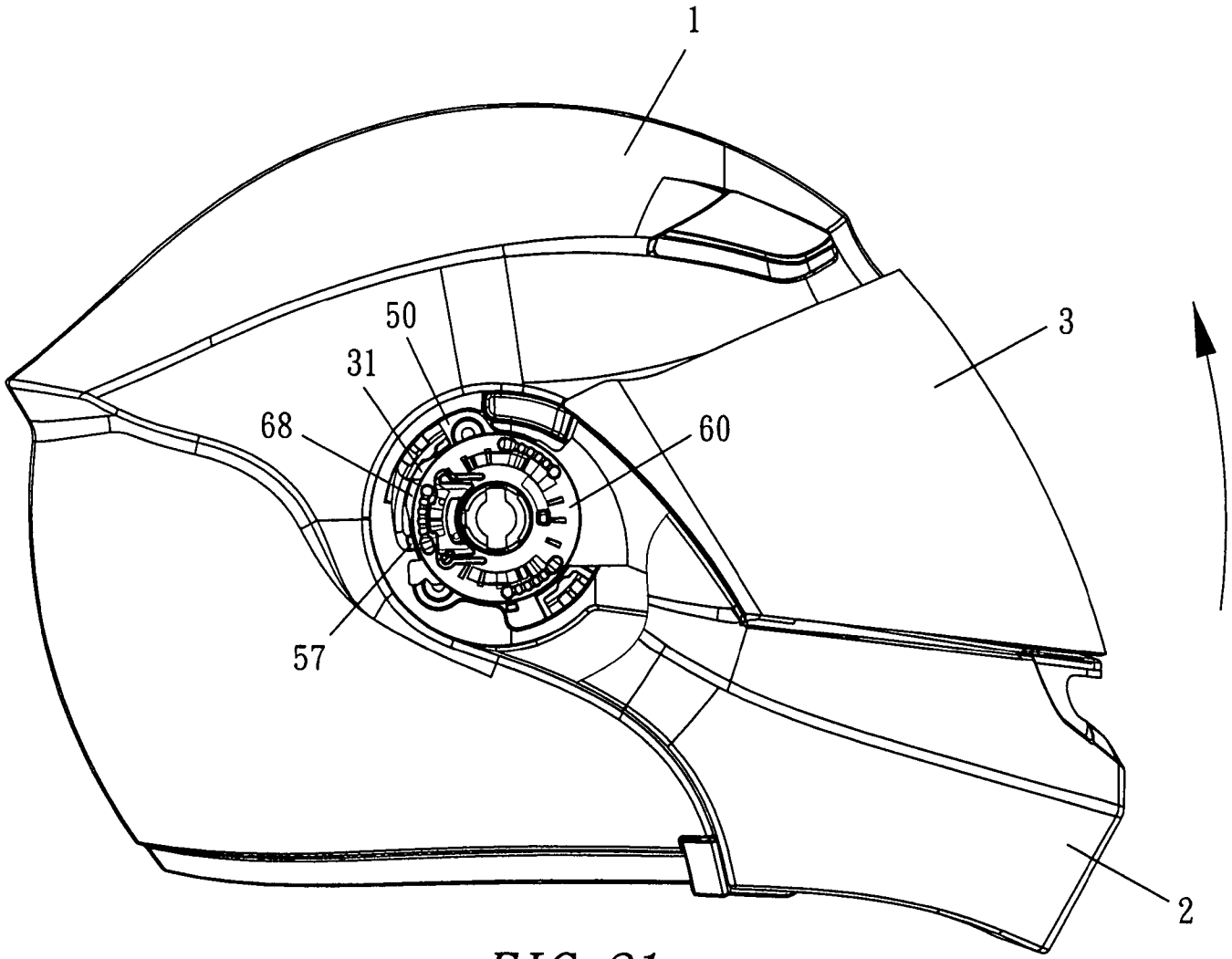
FIG. 21 is a side view showing the closing of the visor of the embodiment of the present invention;
22.
Figure 22:
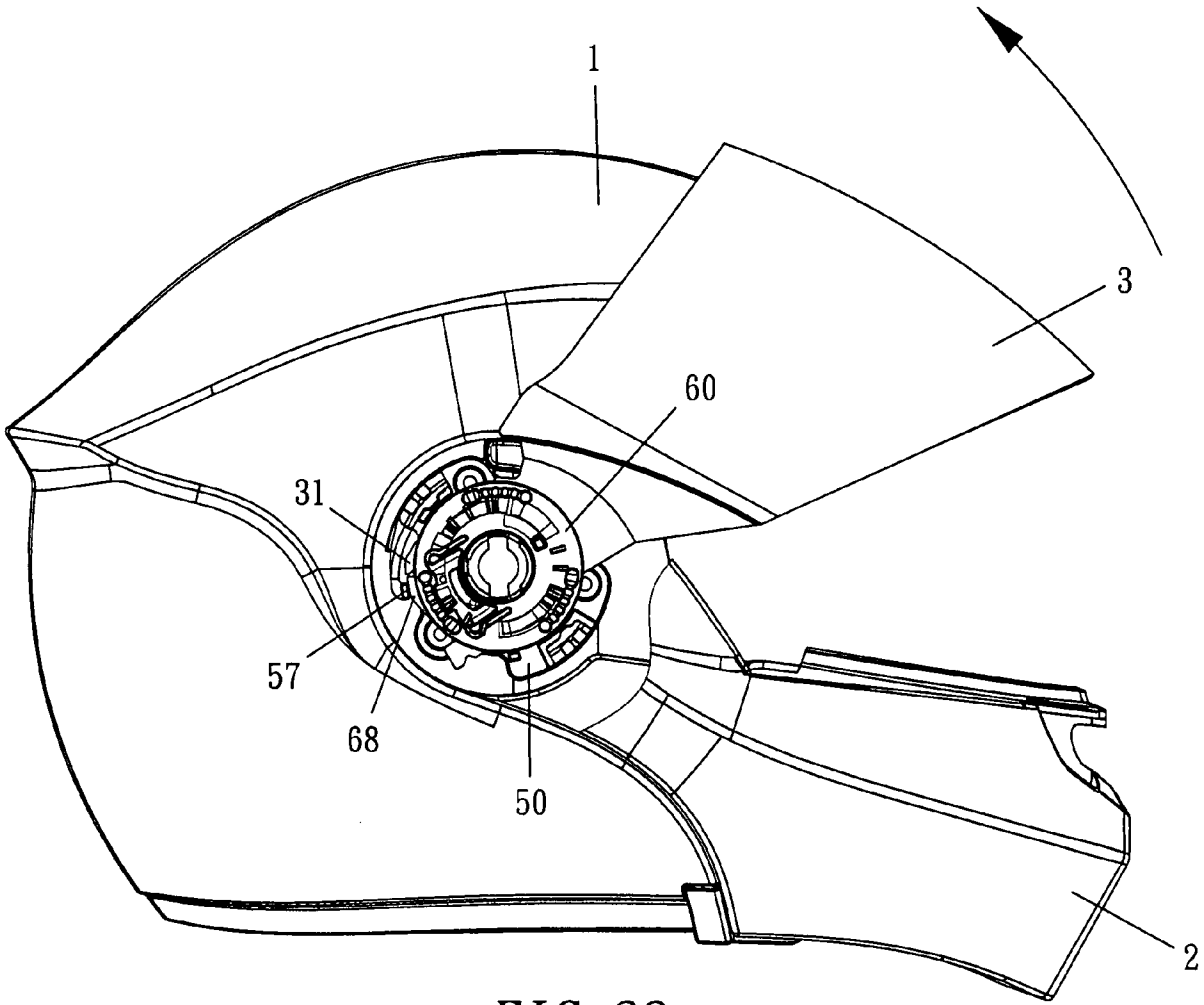
FIG. 22 is a side view showing the half-lifting of the visor of the embodiment of the present invention;
23.
Figure 23:
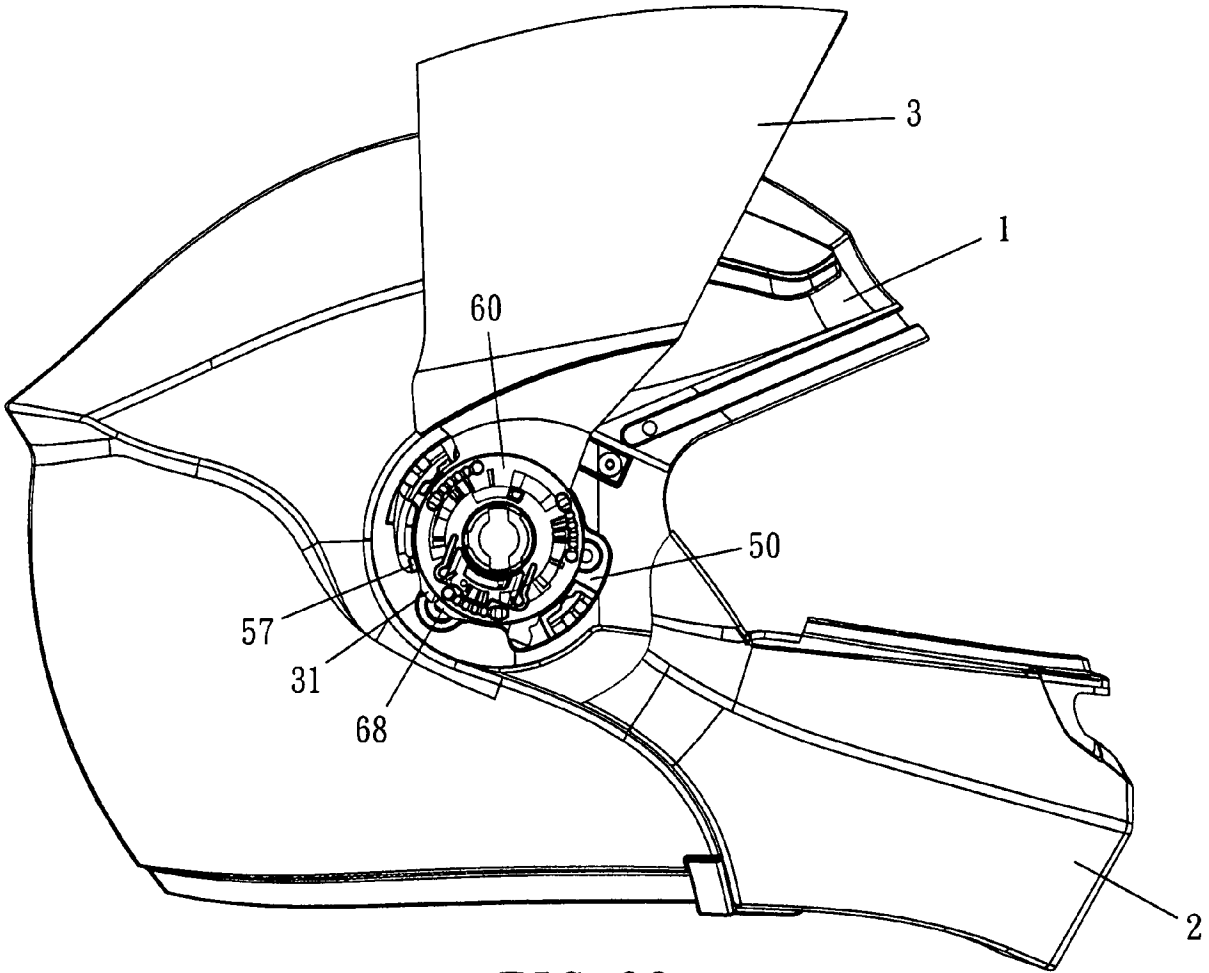
FIG. 23 a side view showing the lifting of the visor of the embodiment of the present invention;
24.
Figure 24:
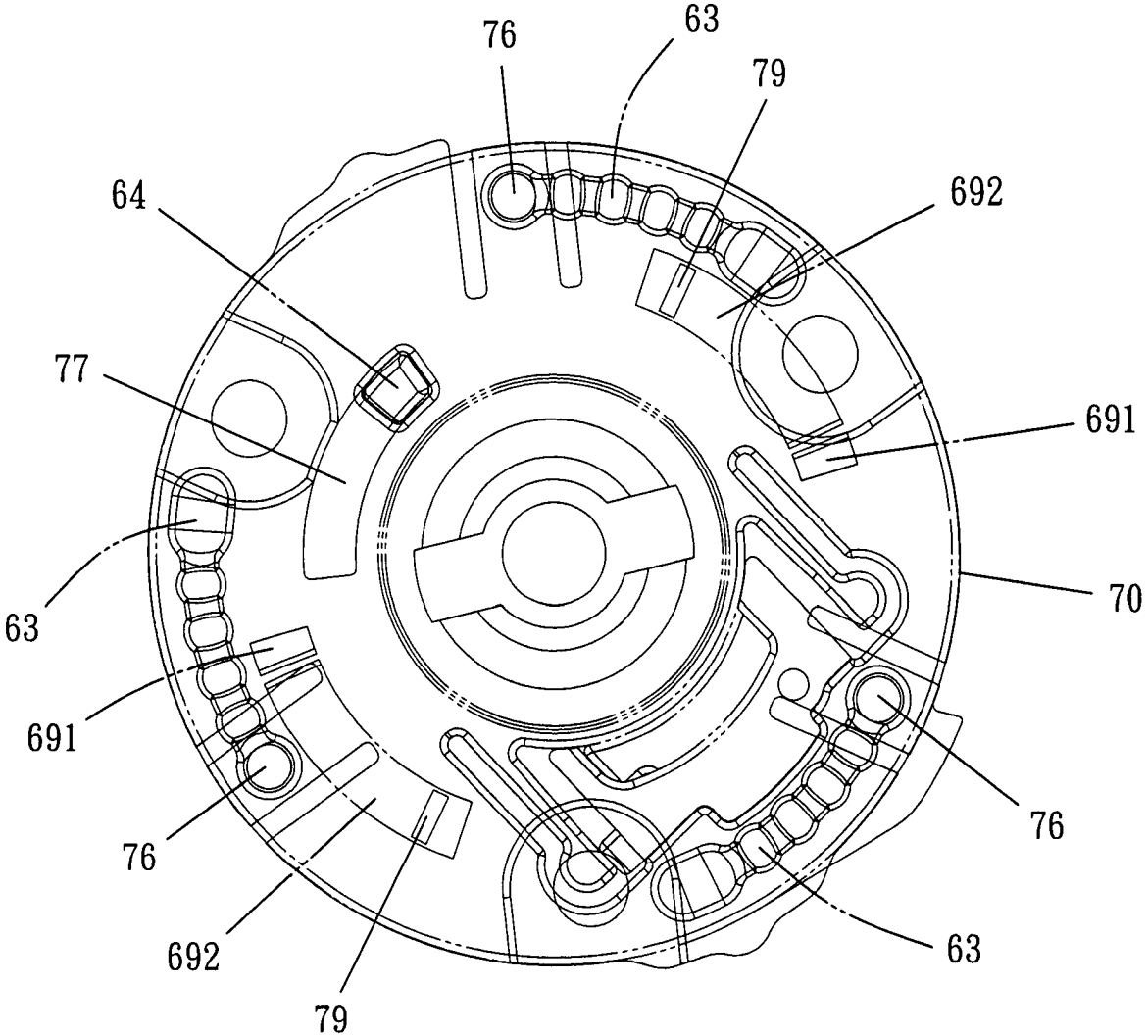
FIG. 24 is a schematic diagram showing the segment disc and the turntable during the closing for the visor of the embodiment of the present invention;
25.
Figure 25:
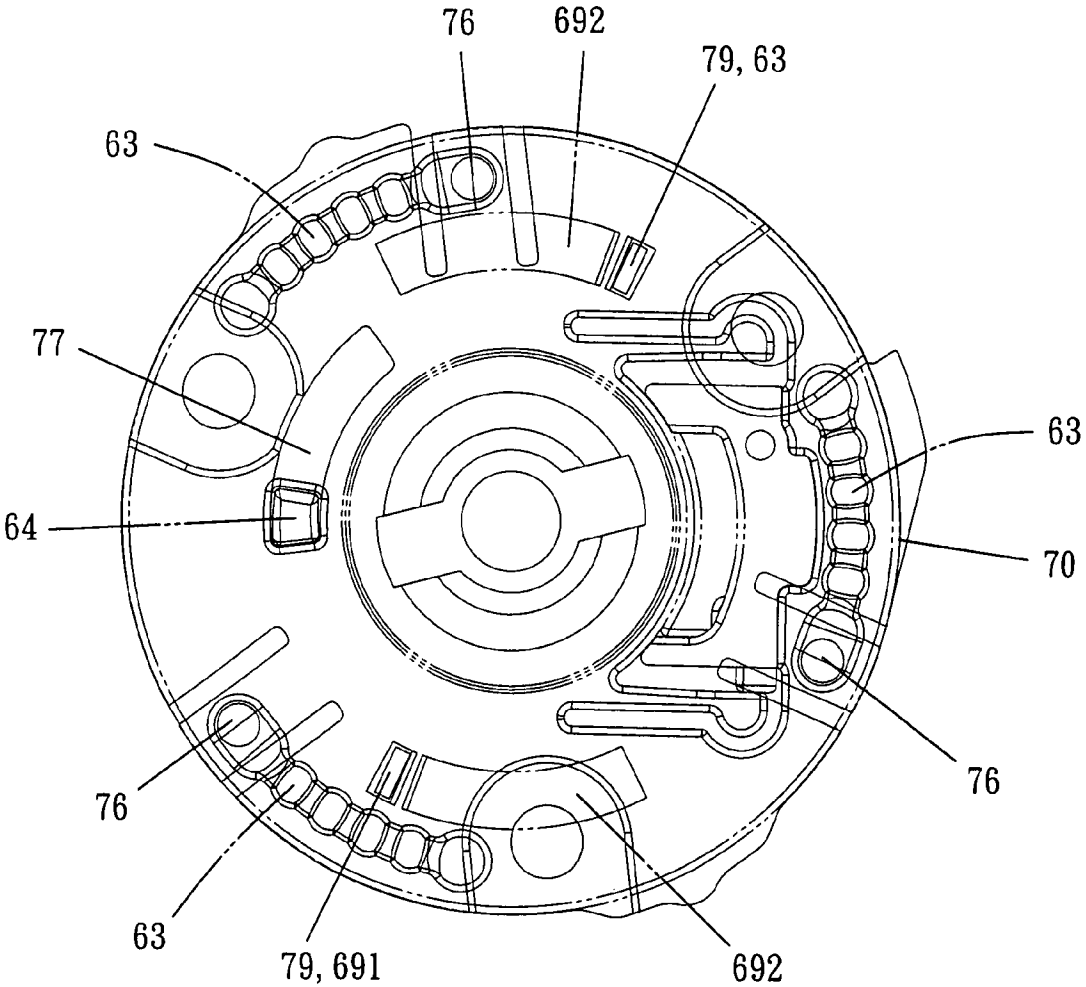
FIG. 25 is a schematic diagram showing the segment disc and the turntable during the lifting for the visor of the embodiment of the present invention; and
26.
Figure 26:
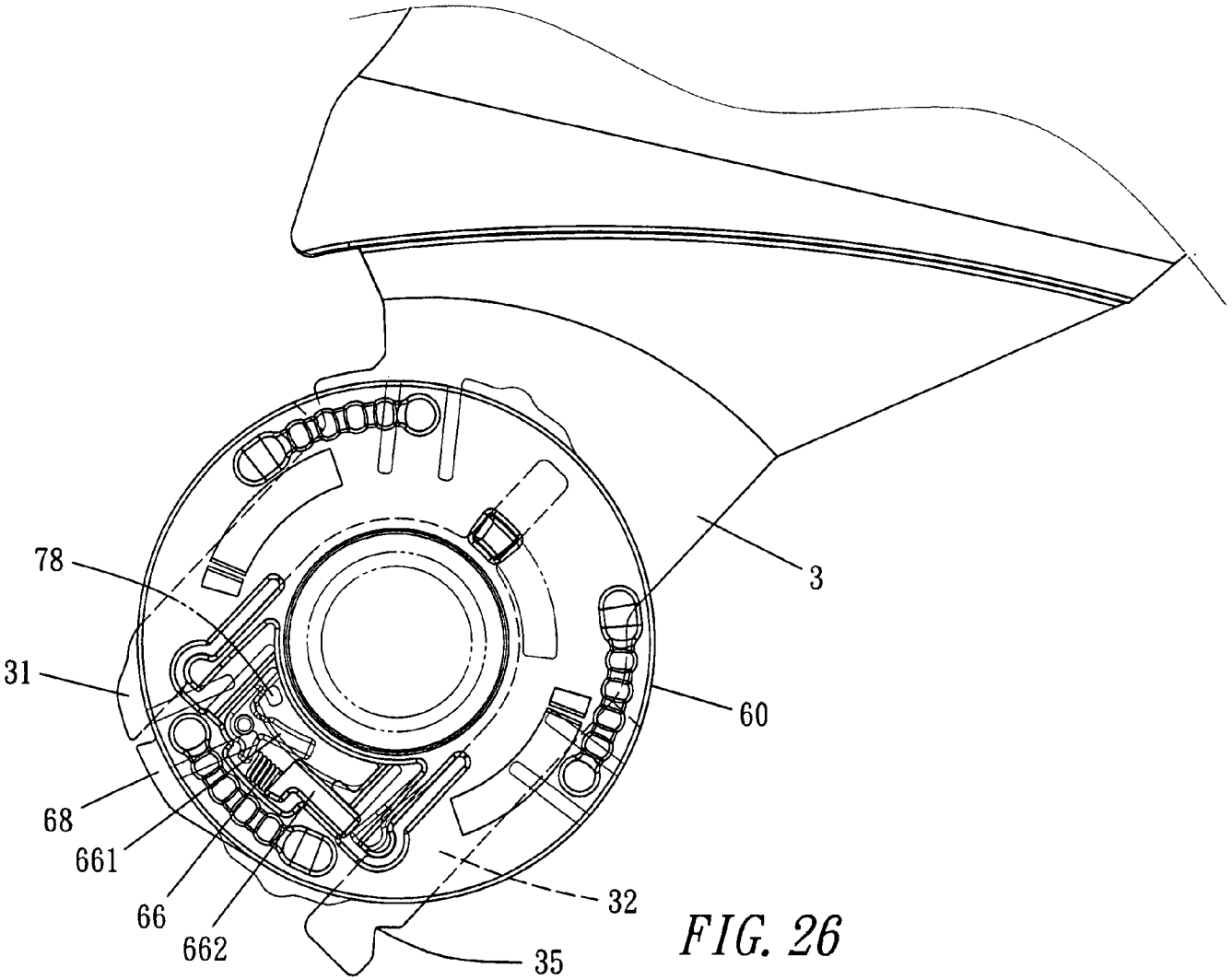
FIG. 26 is a front elevation showing the discharge for the visor of the embodiment of the present invention.

(II.) Once the visor 3 is being lifted alone, the segment disc 60 rotates subject to the lift of the visor 3, but the turntable 70 stays unchanged, and the closing of the visor 3 is shown in FIGS. 16 & 20; as the visor 3 is lifted, the segment disc 60 and the mount 50 are rotating relatively to each other as described in (I.) and shown in FIGS. 17-20, so that any details won't be given again, where the relative rotation with the turntable 70 is shown in FIGS. 24 & 25. The barrier 64 on the exterior of the segment disc 60 is placed in the arced trough 77 of the turntable 70, which is used for guiding and limiting the path and angle for the rotation of the segment disc 60. The elastic bulge 76 of the turntable 70 will change its position relative to that of the cave 63 subject to the extent of the rotation of the segment disc 60, and the protruded bars 79 of the turntable 70 will follow suit to change its position relative to the positions of the shallow notch 691 and the arced shallow trough 692, which makes the visor 3 exhibiting a half-lifting or a complete lifting state, shown in FIGS. 22-23; as the visor 3 is in a complete lift, the top pole 78 of the turntable 70 will touch the prop piece 662 of the segment disc 60, which disables the prop piece 662 in pushing the hold piece 661. As the force that the hold piece 661 exerts on the clasp slice 65 disappears, the visor 3 is then withdrew easily from the segment disc 60, and the visor 3 is ready to be discharged, shown in FIG. 26; reversely, an intent to reload the visor 3, it is only referring the foregoing angle of the segment disc 60, followed by inserting the visor 3 into the hollow segment disc 60, which makes the indents 311, 321 of the up and down sockets 31, 32 to grip with the clasp slice 65 of the segment disc 60, and it is then ready to restore the assembly state shown in FIG. 9.

(III.) As the visor 3 is in a complete lift, the chin shield 2 is being lifted alone, referring to FIGS. 13 & 25, where the chin shield 2 has to be first departed from the protection lump 13 of the shell 1 and then available for lifting upward, and the ear cover 20 is used as a means to activate the rotation of the turntable 70, which facilitates the elastic bulge 76 to move along the cave 63 back to its place, and the protruded bar 79 moves along the arced shallow trough 692 and the shallow notch 691 back to its place until the original state is arrived, shown in FIG. 24. The chin shield 2 and the visor 3 at the moment exhibit a complete lift state as shown in FIGS. 14, 19-20.

Accordingly, the present invention has at least the following advantages and function, which is much more useful and creative than the prior art.

Figure 8:
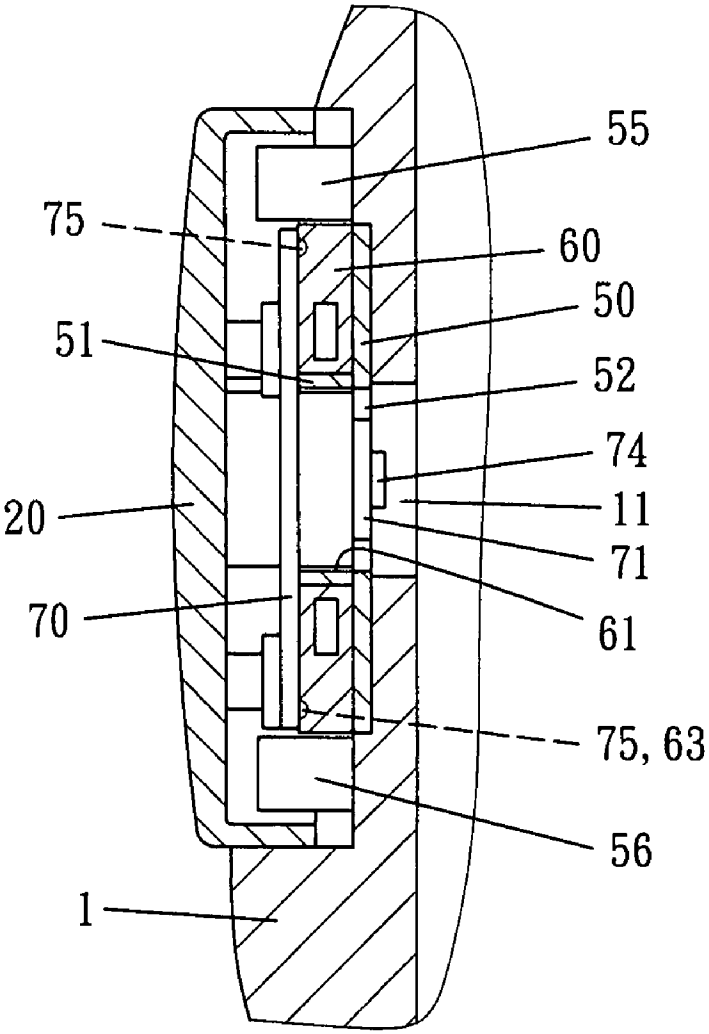
FIG. 8 is an assembled exploded enlarged view of the lift adjusting device of the embodiment of the present invention;
9.
Figure 9:
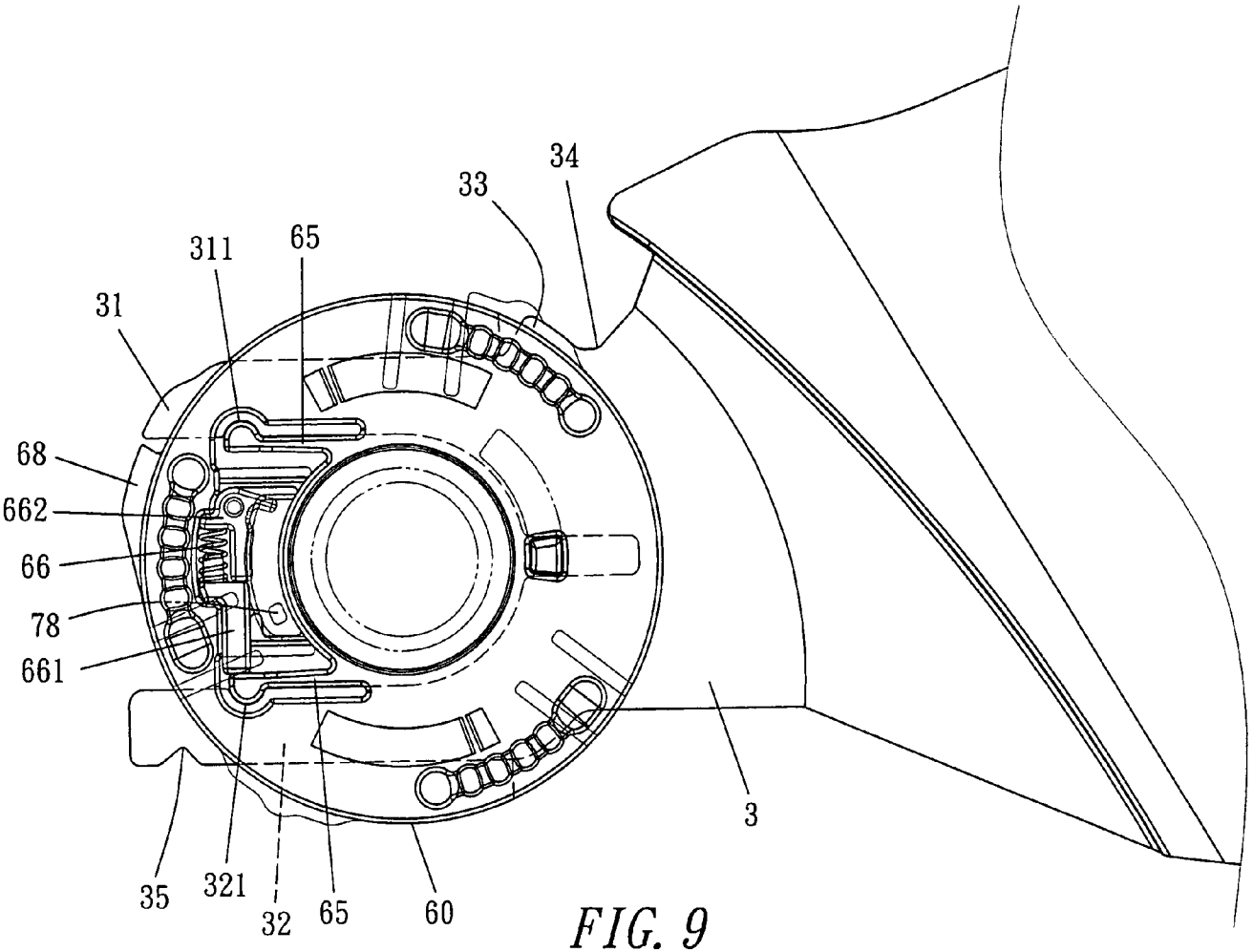
FIG. 9 is a front elevation showing the assembly of the visor and the segment disc of the embodiment of the present invention;
10.

1. The lifting operation is simple, prompt and easy to use and shows continuity.
2. The joining is firm and tight, where the clasp device 4 is not only inserting the slide 43 transversely in the opening 47, but seizing the clasp chunk 45 vertically with the clasp hook 465 mutually that achieves a capability of double joining.
3. The assembly for the chin shield 2 can be done by aiming the tenon 74 of the turntable 70 (fixed in the interior of the ear cover 20) at the clasp hole 52 of the mount 50 with a certain degree, and with a press to locate the tenon 74 in the dent 11 of the shell 1, followed by a twist to have the tenon 74 join the bottom of the mount 50. The assembly for the chin shield 2 (ear cover 20) is done as shown in FIG. 8; otherwise, to reverse a degree so that the tenon 74 is aimed at the clasp hole 52, and the tenon 74 can be automatically bounced off the clasp hole 52 by means of the tension of the chin shield 2, which fulfills the discharge of the chin shield 2. It is apparent that the assembly and the discharge are simple and prompt.
4. The visor 3 not only can be lifted alone, but can be lifted jointly with the chin shield 2, which substantially ease the uses.
5. The visor 3 can be inserted alone and discharged alone as well to facilitate easy load and unload.

In general, the disclosed embodiment of the present invention has been verified to be new with respect to the prior art, which can surely achieve expected objective and function, sufficient to be construed as novelty, non-obviousness and industrial practicality, and has conformed to the requirements of patent statute; therefore, an application for the patent is accordingly to be filed.

What is claimed is:

1. A multifunctional safety helmet, comprising:

a shell, having a concavity at each of its both sides, and a protection lump on the front thereof;

a chin shield, positioned in the front of said shell, where an ear cover is on each of the top sides thereof, and pivoted on both sides of said shell with a fixing by a lift adjusting device;

a clasp device, located in the interior of the front bottom of said chin shield and the interior of the protection lump of said shell, comprising: a button, linked by a spring for automatic rebound; a link pole, with one end connected to the end of the button; a slide, embedded in a seat, and connected to the other end of the link pole; a clasp chunk, positioned under the slide; and a movable clasp body, located at the interior of the protection lump of said shell, and shielded by a cover, where an opening is devised for accommodating the slide, and an elastic element being placed between the clasp body and the cover, and the clasp body comprising a flat piece, a clasp notch and a clasp hook, where the clasp notch is used for accommodating the clasp chunk and for griping with the clasp hook mutually; and a visor, pivoted within the lift adjusting device.

2. A multifunctional safety helmet of claim 1 wherein said clasp device is provided with a long trough in the middle of the button for accommodating a spring.

3. A multifunctional safety helmet of claim 1 wherein said clasp device is provided with a tube at each of two sides ahead of the button for griping a slide piece.

4. A multifunctional safety helmet of claim 3 wherein the slide piece shapes near a triangle, and being put around the bottom interior of the front of said chin shield for rotation, having a post at each of both sides, with one post being placed in the tube of the button while the other is connected to the link pole.

5. A multifunctional safety helmet of claim 1 wherein said clasp device has its elastic element to be a snail-shaped spring.

6. A multifunctional safety helmet of claim 1 wherein the lift adjusting device comprises:

a mount, fixed in the dent of said shell, with an elastic catch ring in the middle thereof, where the catch ring is provided with a clasp hole at its bottom, and a plurality of arced chutes being equally distanced along the catch ring while a plurality of protruding bars between any of two consecutive arced chutes, where a first barrier and a second barrier are located on the external of said mount and are opposite to each other, and the first barrier having its one side extended to form an elastic hook;

a segment disc, put around said mount, and shaped a hollow, where the inner side has a plurality of bulges fitted into the arced chutes of said mount, whereas the outer side has several sets of a plurality of caves and a barrier, and a wedge piece on one side of its rim; and a turntable, fixed at the interior of the ear cover of said chin shield, having a shaft cap in the middle, which includes a spring and a shaft, where the shaft has a tenon at its end, which is used for piercing through said segment disc, followed by joining the tenon with the clasp hole of said mount; where said turntable is provided with a plurality of elastic bulges for placing in the caves of said segment disc and an arced trough for accommodating the barrier of said segment disc.

7. A multifunctional safety helmet of claim 6 wherein the interiors of the first barrier and the second barrier of said mount are provided with an arced chunk.

8. A multifunctional safety helmet of claim 6 wherein said segment disc is provided with two elastic clasp slices in which a fixed hold piece and a rotatable prop piece are placed, and a spring being put in between the hold piece and the prop piece, where a spring cover is shielded on the hold piece, the prop piece and the spring.

9. A multifunctional safety helmet of claim 6 wherein said segment disc is provided with a shallow notch and an arced shallow trough at its exterior, and the corresponding two protruded bars on said turntable being opposite to each other.

10. A multifunctional safety helmet of claim 6 wherein said turntable is provided with a top pole.

11. A multifunctional safety helmet of claim 6 wherein said turntable is provided with two arced bulges opposite to each other on its rim.

12. A multifunctional safety helmet of claim 1 wherein said visor is provided with two corresponding up and down sockets, and the interiors of the two sockets being opposite to each other having an indent each, where the up socket has a jag at its end, and an arced indent at the back of the jag, whereas the down socket has its front protruded over said segment disc and with a slope, and having a clasp notch at its bottom.

13. A multifunctional safety helmet of claim 12 wherein the up and down sockets of said visor has their interiors to form an oval-shaped curve.

* * * * *